US010590740B2

(12) United States Patent
Krawiec et al.

(10) Patent No.: US 10,590,740 B2
(45) Date of Patent: Mar. 17, 2020

(54) MODIFIED DOWNHOLE ISOLATION TOOL HAVING A SEATING MEANS AND PORTED SLIDING SLEEVE

(71) Applicant: Oil Rebel Innovations Ltd., Lloydminster (CA)

(72) Inventors: Peter Steven David Krawiec, Bonnyville (CA); Gregg J. Lacusta, Lloydminster (CA)

(73) Assignee: Oil Rebel Innovations Ltd., Lloydminster, Alberta (CA)

( * ) Notice: Subject to any disclaimer, the term of this patent is extended or adjusted under 35 U.S.C. 154(b) by 0 days.

(21) Appl. No.: 15/996,282

(22) Filed: Jun. 1, 2018

(65) Prior Publication Data

US 2019/0368311 A1 Dec. 5, 2019

(51) Int. Cl.

| | |
|---|---|
| ***E21B 34/14*** | (2006.01) |
| ***E21B 43/12*** | (2006.01) |
| ***E21B 43/38*** | (2006.01) |
| ***E21B 34/00*** | (2006.01) |

(52) U.S. Cl.

CPC ..... *E21B 34/14* (2013.01); *E21B 43/126* (2013.01); *E21B 43/38* (2013.01); *E21B 2034/007* (2013.01)

(58) Field of Classification Search

CPC ..... E21B 34/14; E21B 43/38; E21B 43/126; E21B 2034/007

See application file for complete search history.

(56) References Cited

U.S. PATENT DOCUMENTS

| | | | | |
|---|---|---|---|---|
| 7,219,743 | B2 * | 5/2007 | Wolters | E21B 34/101 166/105 |
| 7,228,914 | B2 * | 6/2007 | Chavers | E21B 34/10 166/332.1 |
| 8,893,776 | B2 | 11/2014 | Lacusta et al. | |
| 8,899,316 | B2 | 12/2014 | Lacusta et al. | |
| 8,955,600 | B2 * | 2/2015 | Lauderdale | E21B 34/063 166/316 |
| 9,016,389 | B2 * | 4/2015 | Frisby | E21B 34/06 166/117 |
| 9,181,785 | B2 * | 11/2015 | Lawson | F04B 47/06 |

* cited by examiner

*Primary Examiner* — David J Bagnell
*Assistant Examiner* — Jonathan Malikasim
(74) *Attorney, Agent, or Firm* — D. Doak Home

(57) ABSTRACT

A downhole isolation tool for insertion in a wellbore and seated engagement to a downhole assembly, for allowing, when a sliding sleeve thereof is slidably positioned in a first position and when coupled to a lower end of said pump apparatus, fluids within a hydrocarbon formation to be drawn through such tool and allowed to pass to the pump apparatus for pumping uphole, and when such sliding sleeve is positioned in a second position and decoupled from said lower end of the pump assembly, for preventing said fluids from passing therethrough and uphole.

20 Claims, 17 Drawing Sheets

MODIFIED DOWNHOLE ISOLATION TOOL HAVING A SEATING MEANS AND PORTED SLIDING SLEEVE

FIELD OF THE INVENTION

The invention relates to a downhole tool and more specifically to an improved downhole tool having a seating means and a modified ported sliding sleeve and seal sub.

BACKGROUND OF THE INVENTION AND DESCRIPTION OF THE PRIOR ART

Normally, when a downhole pump is to be removed for servicing or replacement, the well must be "killed" (i.e. prevent the well from flowing). The downhole tool of the present invention allows for direct sealing attachment to a downhole assembly in order for the well to be temporarily sealed downhole to allow the removal of a downhole pump for servicing or replacement without the need to remove the downhole assembly (e.g. a gas separator).

Specifically, when extracting hydrocarbons from production wells drilled into hydrocarbon formations, it is a safety and regulatory requirement that pressurized fluids and/or gases coming from the drilled well (e.g. sour gases), be isolated from surface to thereby prevent their escape to atmosphere at the surface of the well.

Accordingly, downhole pump assemblies typically possess seal rings, which when the pump is installed in the operative position, typically engage circumferential seals within the casing or tubing in which the downhole pump assembly was placed and positioned, thereby preventing pressurized fluids and/or gases from flowing to surface except through the pump and thereby through the production tubing.

However, any raising of the downhole pump for the purposes of repair or replacement, as taught in the prior art, necessarily disengages the sealing rings, thereby releasing the downhole pressurized fluids and/or gases to surface.

To avoid this undesirable situation and to avoid communication with surface when a downhole pump assembly is being replaced, the prior art teaches that a well be effectively "killed" prior to pump removal, typically by pumping viscous fluids downhole to temporarily seal the well prior to blowout preventer installation and the pump being removed.

The process of "killing" a well each time to service downhole components is costly and time-consuming. Additionally, in some instances, the "killing" process may be too effective where it becomes difficult, and sometimes impossible, to later "restore" the well by removing the viscous fluids. Therefore, a well that is temporarily killed may unintentionally be permanently killed or unable to be brought back on-stream as effectively as before.

In heavy oil formations, where the produced oil contains large amounts of abrasive sand, wear on the pumps is extensive. This results in the necessity to frequently replace the pumps. As described above, replacing the pumps results in the undesirable need in the prior art to "kill" the well so that pressurized fluids and/or gases deep in the formation are not otherwise allowed to flow directly to surface.

Applicant's commonly-assigned U.S. Pat. No. 8,893,776 disclosed a pump assembly for removing hydrocarbons from downhole wells without the need to "kill" the well. The apparatus disclosed therein involved a ported sleeve whereby in an operative first position, fluid is drawn from the well through a first port means in the sidewall of the sleeve, through the hollow interior of the sleeve, and out of the sleeve into the production tubing through a second port means near the upper end. In a closed second position, the ported sleeve shifts upwardly to position the first port means between two sets of seal means within a seal sub that surrounds the ported sleeve, thus sealing off the flow of fluid upwards in the well by preventing access to the lower (first) sidewall port means.

In an alternative design, Applicant's commonly-assigned U.S. Pat. No. 8,889,316 disclosed a downhole isolation tool having a ported sliding sleeve that is slidably positioned within a seal sub that has a port means. In an operative first position, the sliding sleeve is positioned within a bore of the seal sub such that an aperture means in the sidewall of the sleeve is aligned with the port means on the seal sub, allowing fluids to pass from an exterior surface of the seal sub into an elongate cavity within the sleeve. The fluids pass through a hollow internal cavity in the sleeve and out into the production tubing through a second aperture means near the upper end. In a closed second position, the sliding sleeve is moved upwards such that a seal member within the sliding sleeve is aligned with the port means on the seal sub, blocking fluids from the surrounding exterior from entering the sleeve.

These downhole tools provide significant benefits in downhole drilling operations for reasons described above in avoiding the need to "kill" the well prior to pump removal. The isolation tools are particularly well suited for sealing the flow of oil and gas through production tubing and permitting removal of a pump for repair or replacement.

In oil and gas reservoirs, petroleum oil is frequently found in intimate association with natural gas and water. Natural gas may, for instance, be in the form of free gas bubbles entrained in the oil and/or in the form of dissolved gas in the oil. Thus, well fluids commonly comprise both liquids and gas. In wells where artificial lift (pumping) is necessary, the presence of a gas-liquid mixture can materially affect the efficiency of the pumping operations. For example, gas presence in the pumping zone can cause problems such as gas lock, gas pound and gas interference.

Specifically, the presence of gas can reduce pump efficiency because, when gas enters the pump with oil, gas causes many pump problems. It may pocket around the pump or accumulate inside the pump and "gas lock" the valves. "Gas pound" can occur when the gas breaks out of solution and occupies a part of the pump intake chamber. The pump plunger will compress the gas during the down stroke and then contact the fluid. The presence of gas provides some amount of cushion, but the pump can still experience a sudden shock upon striking the fluid, causing "gas pound" followed by "fluid pound". This phenomenon can cause significant damage to the pump assembly and rod string, such as rod buckling, rods rubbing against the tubing causing leaks and, in severe conditions, the splitting of the barrel and/or cages. Attacking downhole gas can reduce pump failures and maximize pump efficiency.

Specialized production equipment is commonly used in oil wells to mitigate damage. In wells where bubbles of gas are present, it is known in the art to use a gas separator (a.k.a. degasser, gas anchor or gas break assembly) to continuously separate the gas from the liquids before the liquid enters the inlet of the pump—the liquids being directed to the suction inlet of the pump and the gas being directed to the casing annulus. Therefore, the gas separator is typically fluidly coupled to the suction inlet of the rod pump, and is therefore located immediately below the rod pump. The efficiency of the separation of liquid and gas by the gas separator is an important aspect of gas separator design, and no gas separator is totally effective in this separation process. Thus, pump repair or replacement is still often required.

Moreover, gas separators frequently become plugged themselves and require that the entire gas separator assembly, or components thereof, be removed from the well for cleaning. This is particularly the case in wells drilled in heavy oil formations, where the produced oil contains large amounts of abrasive sand. It is not uncommon for sand to plug the inlet slots of the dip tube of a gas separator assembly, thereby necessitating removal and cleaning or replacement of the gas separator. Similar to the removal of a pump for repair or replacement, replacing the gas separator results in the undesirable need to "kill" the well so that pressurized fluids and/or gases deep in the formation are not otherwise allowed to flow directly to surface.

In wells equipped with such equipment (e.g. a gas separator) a real need exists for a specialized apparatus and method that is directly compatible with the downhole assemblies and which allows for removing worn or defective pumps without the need to first "kill" the well, and/or is able to avoid the undesirable release of pressurized fluids and/or gases from within the formation to surface via the open well. A need also exists for a downhole tool that permits the cleaning of a downhole assembly, e.g. a gas separator, without the need to remove the assembly and "kill" the well.

SUMMARY OF THE INVENTION

In order to provide certain advantages over the prior art, it is an object of the present invention to provide a downhole isolation tool which is capable of direct seating and sealing engagement to a downhole assembly, such as a gas separator, and which avoids having to otherwise "kill" the well when a downhole pump is desired to be detached from the downhole assembly and removed from the well for repair or replacement It is a further object of the present invention that the isolation tool be configured with a fluid flow path sufficient for functioning of the downhole assembly in an operative position, but which fluid flow path can be altered in a manner that avoids downhole pressures in a hydrocarbon formation from being exposed to surface when desired.

It is a further object of the present invention to allow for fluid in a downhole assembly, such as a gas separator, to be "shut in" within the assembly itself (i.e. not upwardly in production tubing), without breaking wellhead containment when a downhole pump is desired to be removed from the well for repair or replacement.

It is a further object of the invention to provide a downhole isolation tool capable of being positioned immediately adjacent, and in seated and sealed engagement with, a downhole assembly, such as a gas separator, whereby the tool is capable of acting as a fluid flow "stop-gate" between the downhole assembly and other equipment, such as a pump. For instance, in certain situations it may be desirous to prevent flow-through between a gas separator and a pump, even when the pump is not being removed for repair or replacement. This might involve a situation where it is desirous to avoid gas lock and/or gas pound when the gas separator is not capable handling the level of gas interference, but high pressure has built up in the well.

It is a further object of the invention to provide a downhole isolation tool to save rig time in respect of wells containing specialized downhole equipment, such as a gas separator, by eliminating time which would otherwise be required to "kill" the well prior to removal of a downhole pump, and to otherwise restore the rig to operation when the downhole pump assembly is reinserted and the well is desired to then be restored and brought back "on-line".

It is a further object of the invention to provide a downhole isolation tool that can be utilized in association with a downhole pump to permit cleaning of a plugged gas separator. In such mode of operation, by optimal configuration of the flow path through the downhole tool and by its seating and sealing engagement directly to a gas separator, the pump could be unseated and a reverse flush can be used to "flush" the gas separator (e.g. flush sands and other accumulation out of the gas separator and back into the well). The seated and sealed engagement of the downhole tool directly with the gas separator would allow increased pressure to build up in the gas separator, while preventing exposure to the production tubing to the increased pressures. For instance, sealed engagement to the gas separator prevents pressure escaping into the production tubing. Also, after reverse flush, the downhole tool could be immediately adjusted to a closed configuration to hold the increased pressure within the gas separator for an extended period to effectively clear the plug. This operation would advantageously avoid the prior art need to remove the gas separator, or components thereof, for cleaning when the gas separator becomes plugged (e.g. with sand).

It is yet a still-further object of the present invention to provide a downhole isolation tool which allows unseating of a rod insert pump or other pump regardless of downhole pressures or temperatures at a downhole assembly, such as a gas separator.

It is yet a still-further object of the present invention to provide a downhole isolation tool which, by direct seating and sealing engagement to a gas separator, permits a pump to be positioned higher in the well and away from the gas separator. Typically, in wells utilizing gas separators, reciprocating rod pumps are positioned immediately adjacent the gas separator to maintain unregulated downhole reservoir pressures low in the well during pumping. This results in the use of lengthy reciprocating rods to extend from the top of the well to the pump position. In wells with higher deviations in gas-liquid mixtures, this can be problematic for rod wear, e.g. long rods are more susceptible to damage and breaking. Advantageously, by utilizing a downhole tool of the present invention, unregulated downhole reservoir pressures can be handled by the downhole tool, thus allowing a pump to be positioned higher in the well and spaced away from the gas separator where deviations in gas-liquid are more pronounced. This should advantageously reduce rod wear.

It is yet a still-further object of the present invention to provide a downhole tool that can be used in combination with Applicant's downhole tools disclosed in U.S. Pat. Nos. 8,893,776 and 8,889,316. For instance, it is a safety and regulatory requirement that wells with exceedingly high pressures have at least two barriers in place to prevent pressurized fluids and/or gases from escaping into the atmosphere at the surface of a well. Commonly, a wireline plug may be used in such instances. However, the downhole tool of the present invention can advantageously be used in combination with a downhole tool of U.S. Pat. Nos. 8,893,776 and/or 8,889,316 to reversibly and controllably seal a wellbore at two distinct locations. The downhole tool of the present invention may be positioned low in the well attached to a downhole assembly to seal the well at that location, and a separate downhole tool could be used higher up in the production tubing of the well using Applicant's tools disclosed in U.S. Pat. Nos. 8,893,776 and 8,889,316.

Accordingly, in one broad aspect of the present invention, the invention relates to a downhole isolation tool adapted for insertion in a wellbore, which when a component thereof is positioned in a first position allows fluids within said wellbore to be drawn through said tool, and when said component is positioned in a second position prevents said fluids from passing therethrough and up the wellbore, comprising:

(A) an elongate sliding sleeve having an upper and lower end and an elongate cavity therewithin separated into an upper cavity and a lower cavity by a seal member that prevents fluid communication between said upper and lower cavity, further having:

(i) a releasable latch means at said upper end thereof, constructed and arranged for releasably coupling to a lower end of a pump apparatus;

(ii) an opening at said lower end to allow fluid communication between said wellbore and said lower cavity;

(iii) a first aperture means, situated proximate said upper end, in fluid communication with said upper cavity;

(iv) a second aperture means, situated above said seal member and longitudinally separated from said first aperture means, likewise in fluid communication with said upper cavity; and (v) a third aperture means, situated below said seal member and in fluid communication with said lower cavity;

(B) an elongate seal sub, having an upper and lower end and a bore therethrough for slidably receiving therewithin said sliding sleeve and allowing slidable movement thereof from said first position to said second position, further having:

(i) a bypass channel, situated along said bore at a bore surface distal to said upper and lower ends of said seal sub, and bounded by the sidewall of the seal sub, thereby preventing fluid communication exterior to the seal sub from the bypass channel; and (ii) a seating means capable of sealingly engaging said seal sub to an assembly in the wellbore;

wherein said component is said sliding sleeve, and when said sliding sleeve is in said first position it is positioned within said bore so that said second and third aperture means, and said seal member, are aligned with said bypass channel in said seal sub to allow communication of fluids from said lower cavity to said upper cavity of said sliding sleeve via said bypass channel; and when said sliding sleeve is in said second position, said first aperture means and said seal member are positioned towards said upper end of said seal sub, above said bypass channel, to thereby prevent communication of fluids from said lower cavity to said upper cavity of said sliding sleeve.

In a further refinement of the above embodiment, in said second position said seal member aligns with and engages a circumferential seal means in said bore of said seal sub, situated above said bypass channel.

In a further refinement of the above embodiments, said bypass channel is a circumferential channel in the surface of the bore.

In a still further refinement of the above embodiments, said seating means is situated on an exterior surface at said lower end of said seal sub. In a further refinement, said seating means is capable of sealingly engaging a circumferential seal situated on a seating surface of said assembly.

In a still further refinement of the above embodiments, said assembly in said wellbore is a gas separator assembly.

In a still further refinement of the above embodiments, said tool is adapted to be releasably coupleable to a lower end of a pump apparatus when said sliding sleeve is in said first position, and when said sliding sleeve is in said second position is adapted to be decoupled from said lower end of said pump apparatus.

In a still further refinement of the above embodiments, movement limiting means, such as a stop means, may be provided to prevent further upward movement of said sliding sleeve within said bore upon said sliding sleeve being repositioned from said first position to said second position.

In a still further refinement of the above embodiments, said downhole tool is further provided with releasably-engageable detent means, engageable when said sliding sleeve is in said second position to prevent or resist downward slidable movement of said sliding sleeve, and adapted to become disengaged upon said pump apparatus being lowered onto said downhole tool and said releaseable latch means, and said sliding sleeve being forced downwardly by said pump apparatus.

In a still further refinement of the above embodiments, said downhole tool is further provided with releasably-engageable detent means engageable when said sliding sleeve is in said first position to prevent or resist further downward slidable movement of said sliding sleeve.

In a second broad aspect, the present invention relates to a method for preventing at least one of downhole fluids and gases in a hydrocarbon formation from reaching surface upon removal of a pump apparatus from a wellbore, using a downhole tool comprising an elongate sliding sleeve and an elongate seal sub, comprising the steps of:

(a) providing an elongate sliding sleeve having an elongate cavity therewithin separated into an upper cavity and a lower cavity by a seal member that prevents fluid communication between the upper and lower cavity, said upper cavity having a first and second aperture therein and said lower cavity having a third aperture therein;

(b) providing an elongate seal sub having a bore therethrough and a bypass channel situated along said bore;

(c) slidably inserting said elongate sliding sleeve within said bore of said seal sub to a first position where said second and third apertures, and said seal member, are aligned with said bypass channel situated within said bore of said seal sub to allow communication of fluids from said lower cavity to said upper cavity of said sliding sleeve by bypassing the seal member via said bypass channel;

(d) either before or after step (c), releasably coupling, via releasable latch means on an upper end of said sliding sleeve, said downhole tool to a lower end of a pump apparatus;

(e) inserting said downhole tool and pump apparatus downhole into a wellbore;

(f) sealingly engaging said downhole tool and pump apparatus to an assembly in said wellbore via a seating means situated on said seal sub;

(g) operating said pump apparatus;

(h) raising said pump apparatus and causing said sliding sleeve to be slidably re-located upwardly in said bore from said first position to a second position where said first aperture means and said seal member are positioned above said bypass channel in said bore of said seal sub, to thereby prevent communication of fluids from said lower cavity to said upper cavity of said sliding sleeve;

(i) pulling said pump apparatus upward so as to releasably disengage latch means on said sliding sleeve from said lower end of said pump apparatus; and (j) removing said pump apparatus from said wellbore.

In a further refinement of the above method, step (h) comprises slidably relocating said sliding sleeve upwards until said seal member aligns with and engages a circumferential seal means in said bore of said seal sub.

In a further refinement, said method further comprises further utilizing stop means on said downhole tool to prevent further upward movement of said sliding sleeve past said second position.

In a further refinement, said method further comprises after step (j), the steps of: (k) lowering said pump assembly within said wellbore so as to cause said pump apparatus to push downwardly on said sliding sleeve; and (l) causing said sliding sleeve to move from said second position back to said first position.

In an third broad aspect, the present invention relates to a downhole isolation tool for insertion in a wellbore, which when configured to a first position allows fluids within a hydrocarbon formation to be drawn through said tool, and when configured to a second position prevents said fluids from passing therethrough and up the wellbore, comprising:

(A) an elongate sliding sleeve having an upper and lower end and an elongate cavity therewithin separated into an upper cavity and a lower cavity by a seal member that prevents fluid communication between said upper and lower cavity, further having:

(i) a releasable latch means at said upper end thereof, constructed and arranged for releasably coupling pump apparatus;

(ii) an opening at said lower end to allow fluid communication between said wellbore and said lower cavity;

(iii) a first aperture means, situated proximate said upper end, in fluid communication with said upper cavity;

(iv) a second aperture means, situated above said seal member and longitudinally separated from said first aperture means, likewise in fluid communication with said upper cavity;

(v) a third aperture means, situated below said seal member and in fluid communication with said lower cavity; and (B) an elongate cylindrical seal sub, having an upper and lower end and, along a longitudinal axis of said seal sub, a bore therethrough for slidably receiving therewithin said sliding sleeve and allowing slidable movement thereof from said first position to said second position, further having:

(i) a bypass channel, situated along said bore at a bore surface distal to said upper and lower ends of said seal sub, and bounded by the sidewall of the seal sub, thereby preventing fluid communication exterior to the seal sub from the bypass channel; and (ii) a seating means capable of sealingly engaging said seal sub to an assembly in the wellbore;

wherein when said downhole tool is configured in said first position, said sliding sleeve is positioned within said bore so that said second and third aperture means, and said seal member, are aligned with said bypass channel in said seal sub to allow communication of fluids from said lower cavity to said upper cavity of said sliding sleeve via said bypass channel; and wherein when said sliding sleeve is slidably moved upwardly so as to thereby be configured in said second position, said first aperture and said seal member are positioned above said bypass channel to thereby prevent communication of fluids from said lower cavity to said upper cavity of said sliding sleeve.

In a refinement of the above embodiment, in said second position said seal member aligns with and engages a circumferential seal means in said bore of said seal sub, situated above said bypass channel.

In a further refinement of the above embodiments, said bypass channel is a circumferential channel in the surface of the bore.

In a further refinement of the above embodiments, said seating means is capable of sealingly engaging a circumferential seal situated on a seating surface of said assembly.

In a still yet further refinement of the above embodiments, said assembly in said wellbore is a gas separator assembly.

BRIEF DESCRIPTION OF THE DRAWINGS

Further advantages and permutations and combinations of the invention will now appear from the above and from the following detailed description of the various particular embodiments of the invention taken together with the accompanying drawings, each of which are intended to be non-limiting, in which:

FIG. 3A is a cross-sectional view of a prior art downhole ported sleeve, where the sleeve is positioned in a first position allowing flow of hydrocarbons into a first port means and out of a second port means so as to enable flow uphole to a pump apparatus or the like;

FIG. 5A is a cross-sectional view through another prior art downhole isolation tool, where the sliding sleeve is positioned in a first position allowing flow of hydrocarbons into a second aperture, via a port in a seal sub, and out of a first aperture therein so as to enable flow uphole to a pump apparatus or the like;

FIG. 7A is a cross-sectional view through an embodiment of a downhole isolation tool of the present invention, where the sliding sleeve is positioned in a first position allowing hydrocarbons in a lower cavity to flow through second and third aperture means, via alignment with a bypass channel, thereby bypassing a seal member to access an upper cavity so as to enable flow uphole to a pump apparatus or the like;

DETAILED DESCRIPTION OF PREFERRED EMBODIMENTS

Figure 1A:
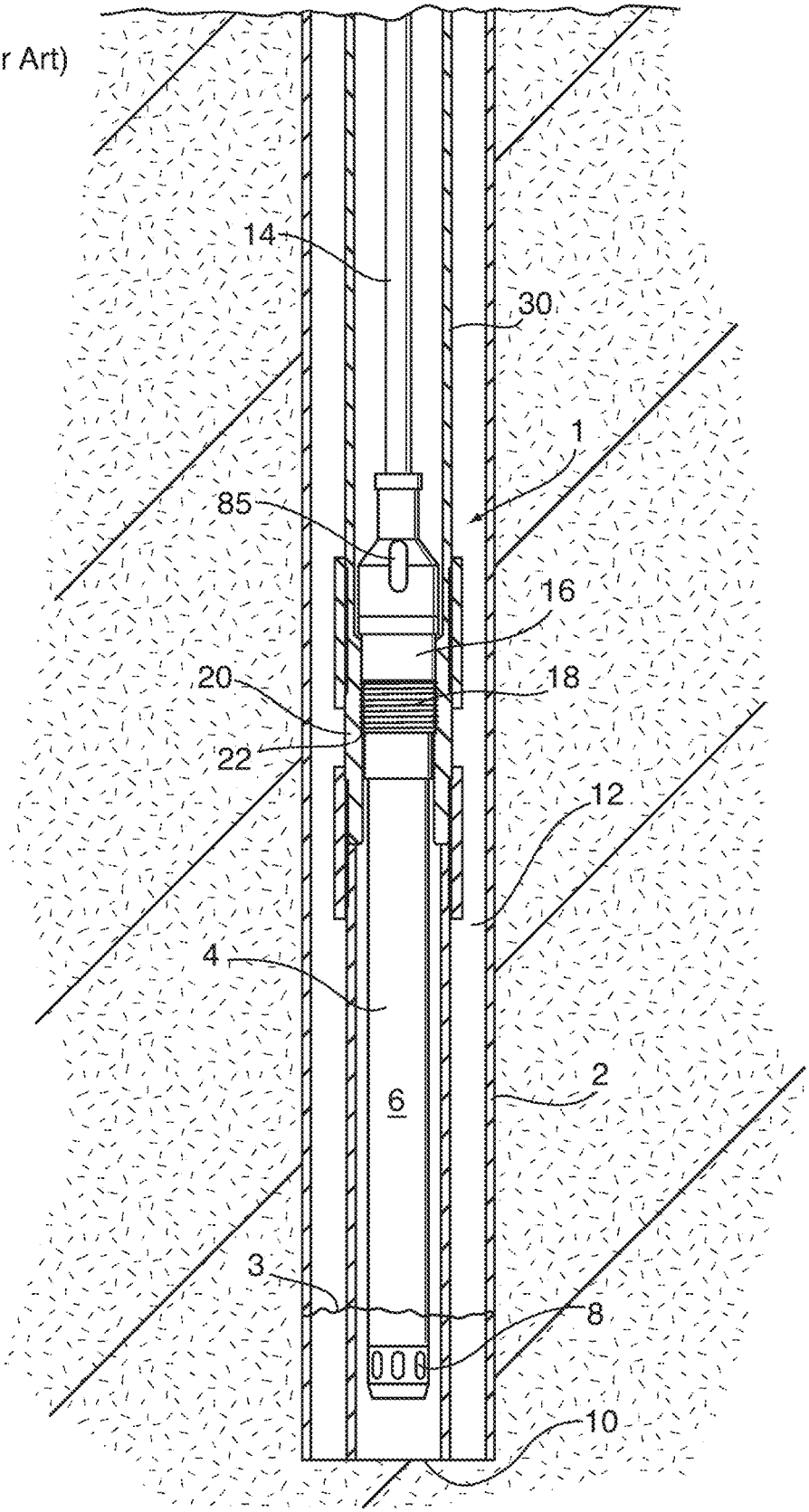
Fig.1A ( Prior Art)
FIG. 1A is a cross-sectional view of a prior art downhole tubing assembly in "top hold down" configuration and having a seating surface.

Referring to FIG. 1A, a downhole pump apparatus 1 of the prior art in a "top hold down" configuration is shown. The pump apparatus 1 is installed in a downhole operative (pumping) position in well casing 2 of a production well 12. The pump apparatus 1 is situated within production tubing 30 and comprises a pump assembly 4 having a pump 6 and a pump intake 8. The pump intake 8 may comprise a plurality of openings arranged around the circumference of the pump assembly 4 and/or comprise a single opening at the bottom of the pump assembly 4.

A production fluid (e.g. oil 3) being produced from the bottom 10 of well 12 enters pump intake 8 and is pumped upwardly within pump assembly 4 by pump 6 so as to be forced out exit aperture 85 within a top portion of pump assembly 4 and directly into production tubing 30 and thereby forced upwardly to surface.

In the downhole operative pumping position shown, pump assembly 4 is situated proximate the bottom 10 of well 12. A seating surface 18 on hold-down member 16 sealingly engages a circumferential seal 22 on seating nipple 20 situated within production tubing 30. This arrangement prevents the unregulated flow of pressurized fluids and/or gases otherwise than through the pump 6 and production tubing 30.

The configuration shown in FIG. 1A is commonly referred to in the art as a "top hold down" configuration, wherein the pump assembly 4 is situated below seating nipple 20 and thus the exterior of pump 6 is disadvantageously exposed to unregulated downhole reservoir pressures during pumping.

Pump 6 forming part of pump assembly 4 may comprise a rod pump and a rod string encased within polish rod 14 which reciprocates up and down and is provided to power pump 6. Alternatively, pump 6 may comprise electric submersible pumps or progressive cavity pumps, or any type of pump which may require removal for servicing and/or replacement.

Figure 1B:
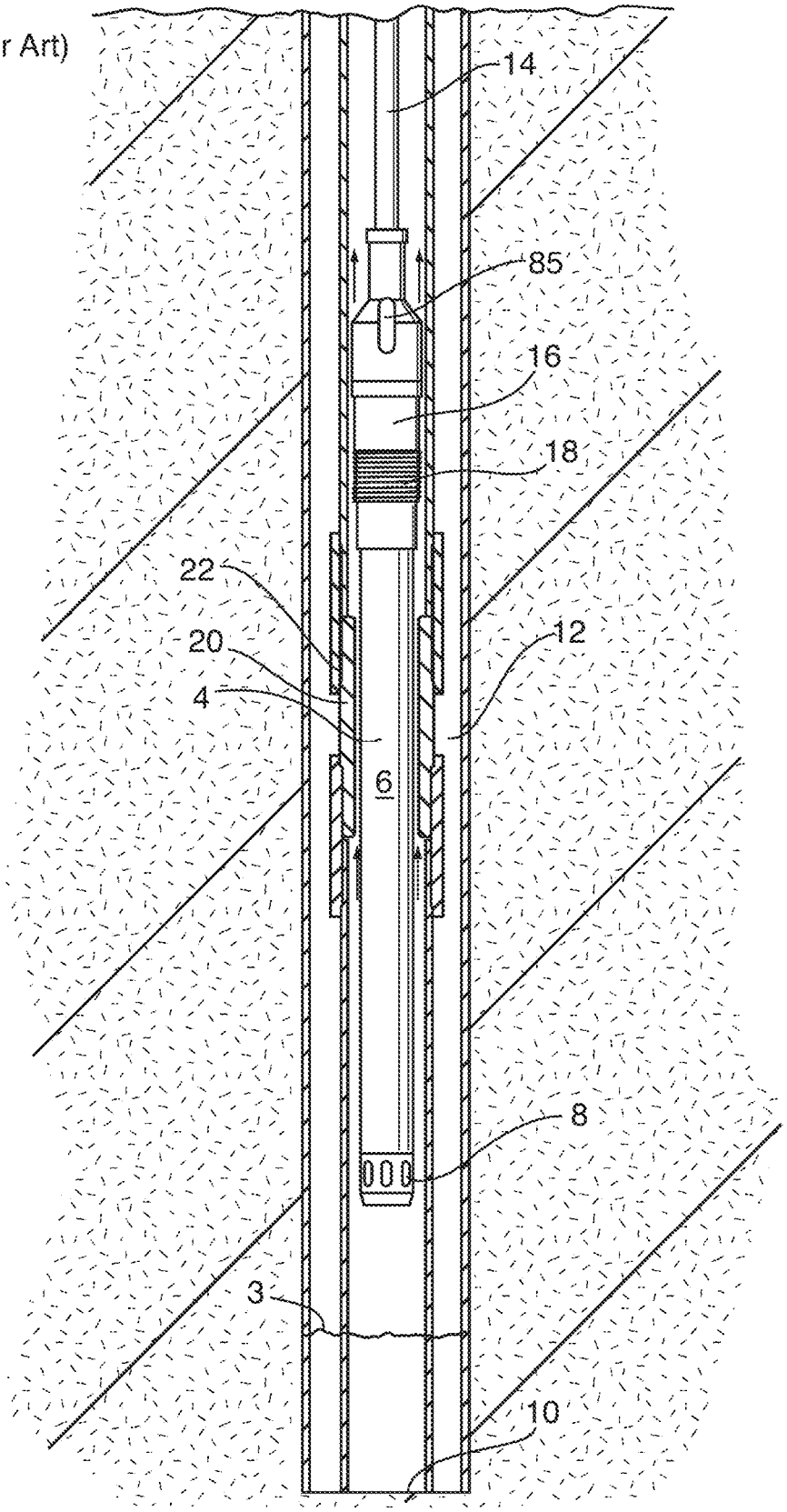
Fig.1B ( Prior Art)
FIG. 1B is a cross-sectional view of the prior art downhole tubing assembly of FIG. 1A, with the downhole pump assembly partially removed.

Referring to FIG. 1B, pump assembly 4 is being removed from the well 12 for the servicing or replacement of pump 6. Disadvantageously, as the pump assembly 4 is being raised from well 12, seating surface 18 on hold-down member 16 is raised and thereby removed from, and no longer sealingly engages, circumferential seal 22 on seating nipple 20. In such circumstances, downhole pressurized fluids and/or gases within the hydrocarbon formation may then flow uphole in an unregulated manner (as indicated by arrows) since the pressurized fluids and/or gases are no longer required to flow in a regulated manner through pump 6.

Figure 1C:
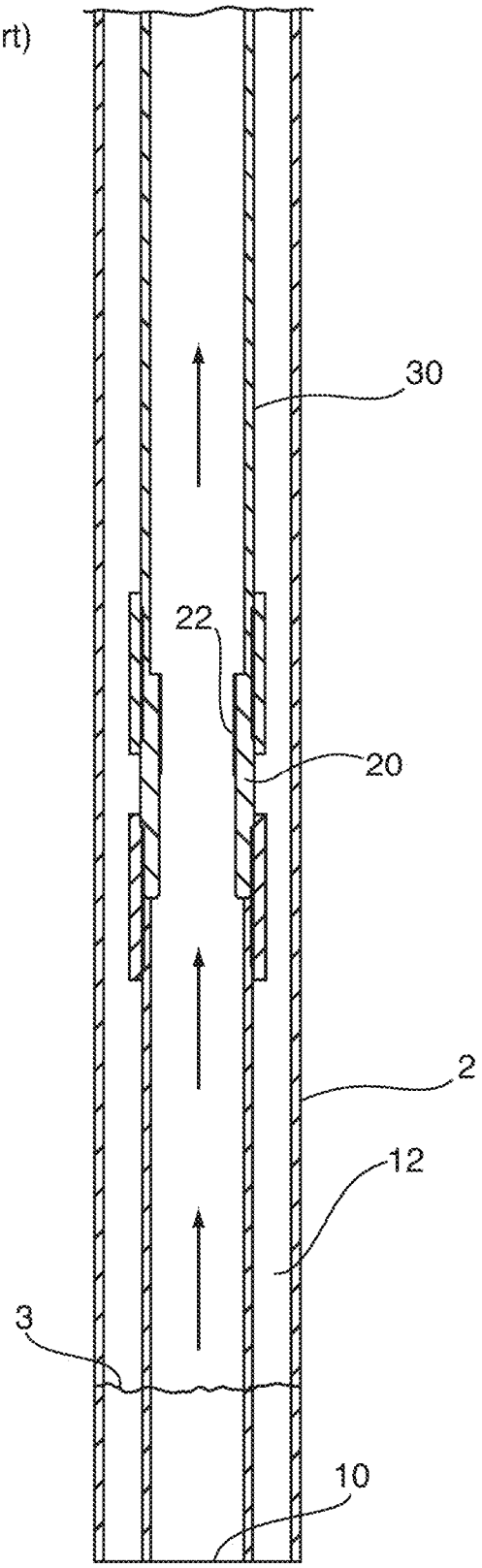
Fig.1C( Prior Art)
FIG. 1C is a cross-sectional view of the downhole tubing assembly of the prior art, with the pump and seating surface thereof removed from the well.

Referring to FIG. 1C, the pump assembly 4, including seating surface 18, has been completely removed from well 12, and downhole pressurized fluids and/or gases within the hydrocarbon formation are given free flow uphole in an unregulated manner (indicated by arrows). The downhole pressurized fluids and/or gasses will then be directly exposed to surface, via production tubing 30, unless the well has been previously "killed".

As seen in FIGS. 1A-1C, due to the "top hold down" configuration of pump assembly 4, the thin exterior of pump 6 is exposed to downhole reservoir pressures, which in high pressure reservoirs, can lead to pump 6 damage.

The present invention is adapted for use in association with any type of downhole pump 6 used in applications shown similar to that shown in FIGS. 1A-1C for pumping well bore fluids, e.g. where a "top hold down" configuration is used.

Particularly, the present downhole isolation tool is adapted for uses such as that shown in FIGS. 1A-1C where a downhole pump 6 is required and in which the downhole pump 6 has to be removed from the well 12 for purposes of servicing or replacement.

More particularly, the present downhole isolation tool is adapted for uses in which a pump assembly 4 is in a "top hold down" configuration and is positioned above another downhole assembly, such as a gas separator, and in which it is advantageous to seat and sealingly engage the downhole isolation tool of the present invention to the downhole assembly so that the downhole pump 6 can be removed from the well 12 for purposes of servicing or replacement.

Figure 2A:
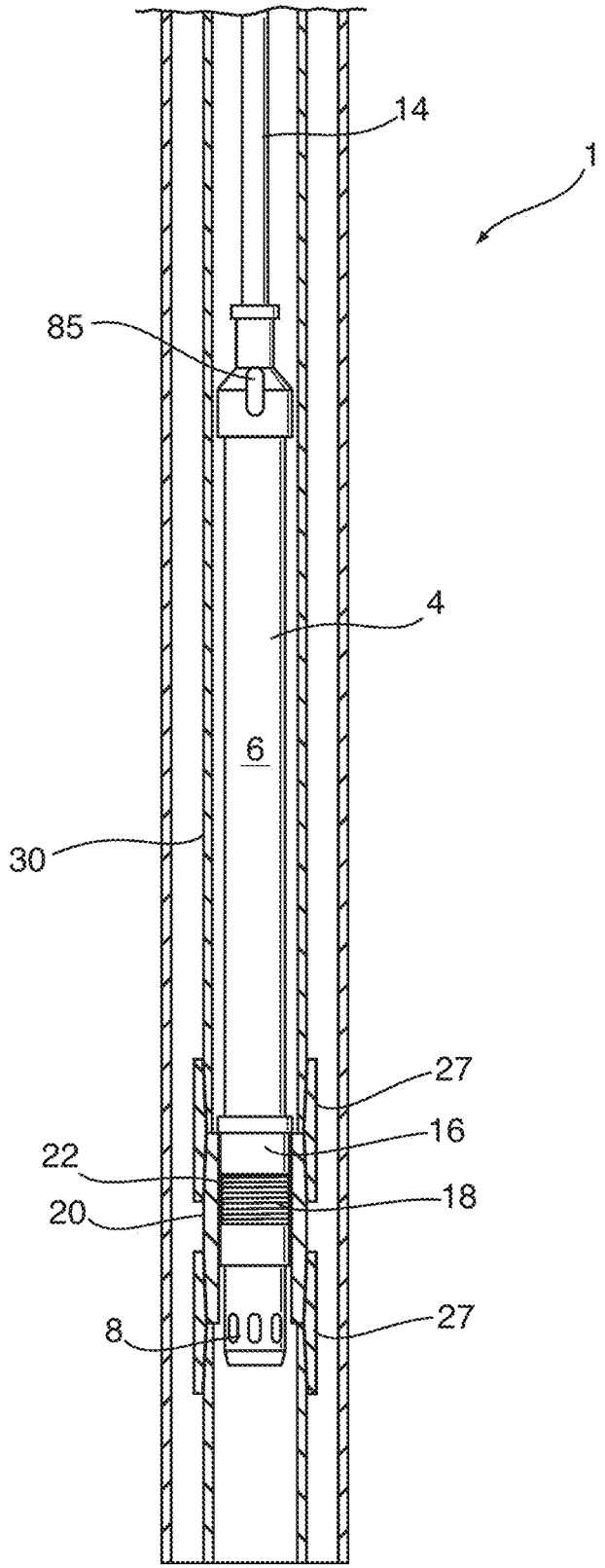
Fig. 2A (Prior Art)
FIG. 2A is a cross-sectional view of an alternative prior art downhole tubing assembly in "bottom hold down" configuration.

Referring to FIG. 2A, a modified pump apparatus 1, also used in the prior art, is shown in a "bottom hold down" configuration. In such a configuration, the downhole pump assembly 4 is positioned above seating surface 18 on hold-down member 16, thereby preventing, due to the sealing engagement of seating surface 18 with circumferential seal 22 on seating nipple 20, pressurized liquids and/or gases from within the reservoir from bypassing the downhole pump 6 and thereby flowing to surface in an unregulated manner via production tubing 30. Since the pump assembly 4 is positioned above seating surface 18 on hold-down member 16, the pump 6 is positioned above the hold-down assembly so as not to be directly exposed to downhole reservoir pressure. Such a "bottom hold down" configuration is typically used in applications where there are concerns of excessive reservoir pressures which could possibly collapse the thin outer barrel of downhole pump 6. Such configurations may alternatively or additionally be used in applications where the downhole pump 6 is to be seated and sealingly engaged to another downhole assembly, such as a gas separator. For instance, seating surface 18 on hold-down member 16 may be sealingly coupled to a circumferential seal 22 on seating a seating surface situated within the downhole assembly.

Figure 2B:
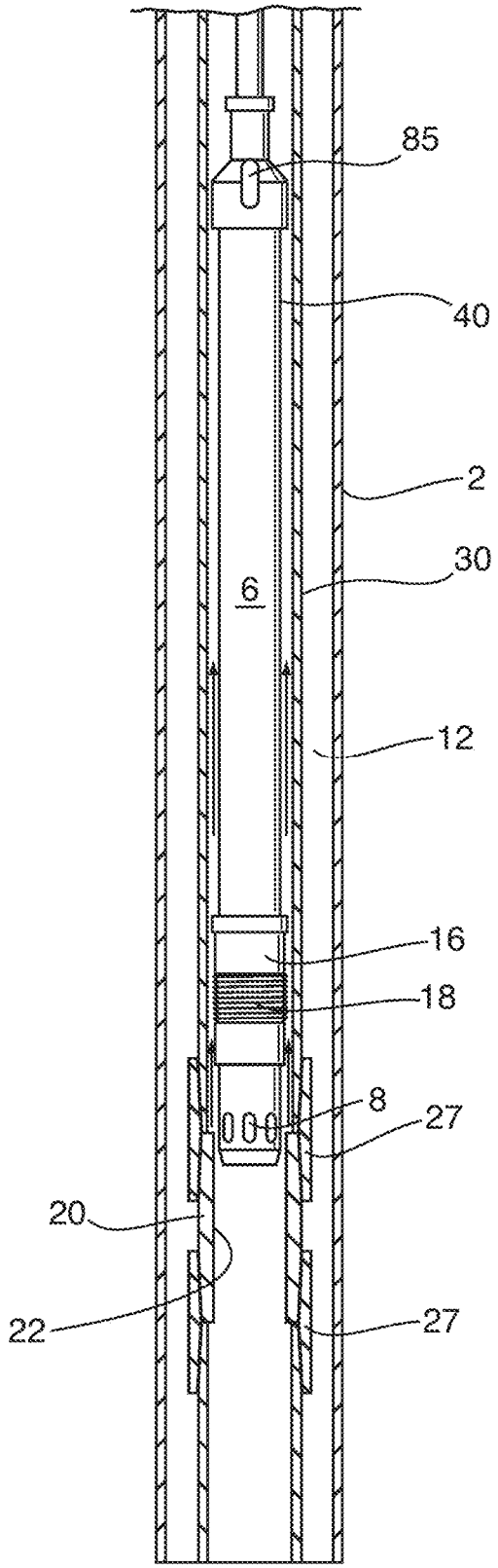
Fig. 2B (Prior Art)
FIG. 2B is a cross-sectional view of the prior art downhole tubing assembly of FIG. 2A, with such prior art downhole assembly partially removed from the well.

Referring to FIG. 2B, pump assembly 4 is being removed from the well 12 for servicing or replacement. Disadvantageously with regard to this configuration, as was the case with the prior art apparatus shown in FIGS. 1A-1C, as the pump assembly 4 is being raised from well 12, seating surface 18 on hold-down member 16 is raised from, and therefore no longer sealingly engages, circumferential seal 22 on seating nipple 20. The loss of sealing engagement of seating surface 18 with circumferential seal 22 on seating nipple 20 permits downhole pressurized fluids and/or gases to flow uphole in an unregulated manner (indicated by arrows).

Figure 2C:
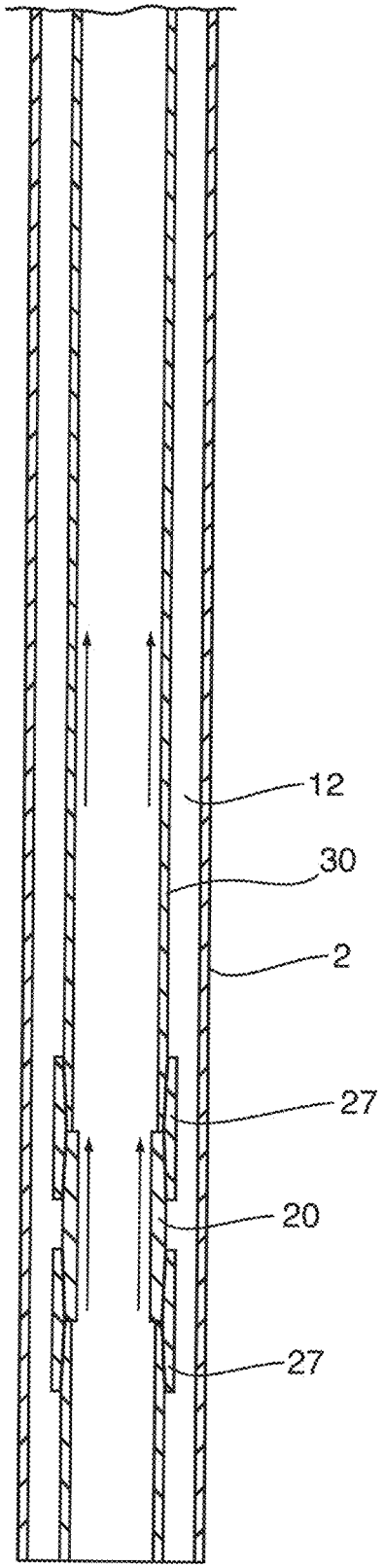
Fig. 2C (Prior Art)
FIG. 2C is a cross-sectional view of the downhole tubing assembly of the prior art shown in FIGS. 2A-2B, with the pump removed for servicing or replacement.

Referring to FIG. 2C, the pump assembly 4, including seating surface 18, has been completely removed from the production well 12, and downhole fluids and/or gases within the hydrocarbon formation are given free flow uphole in an unregulated manner (indicated by arrows). The downhole pressurized fluids and/or gases will then be directly exposed to surface, via production tubing 30, unless the well has been previously "killed".

Applicant's commonly assigned U.S. Pat. Nos. 8,893,776 and 8,889,316, incorporated in their entirety herein by reference, disclose downhole isolation tools that are suitable in many applications to permit a well 12 to be temporarily sealed downhole to allow the removal of a downhole pump 6 for servicing or replacement. While these downhole tools provide significant advantages over the prior art apparatuses and methods of FIGS. 1A-1C and FIGS. 2A-2C, limitations exist in that the downhole tools do not adequately address situations in which it would be beneficial to have the downhole isolation tool directly seat and sealingly engage a specialized downhole assembly, such as a gas separator. Particularly, these downhole isolation tools do not provide sliding sleeve and seal sub configurations to readily permit such specialized applications, including appropriate seating means and fluid flow paths through the sliding sleeve and seal sub. These features are advantageously disclosed herein as aspects of the novel downhole isolation tool of the present invention.

Figure 3A:
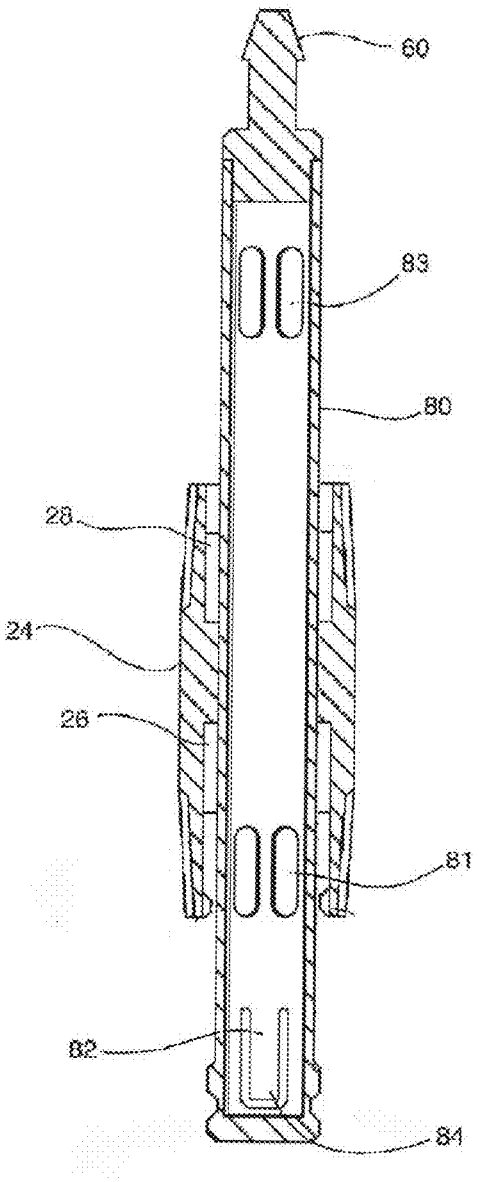
Fig. 3A (Prior Art)
Figure 3B:
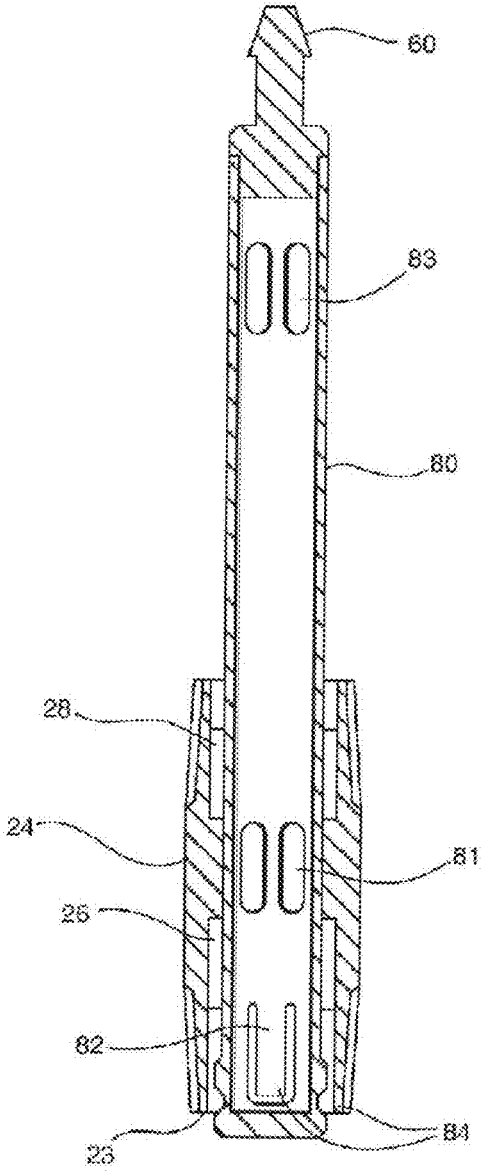
Fig. 3B (Prior Art)
FIG. 3B is a cross-sectional view of the downhole ported sleeve shown in FIG. 3A, where the sleeve is repositioned to a second position wherein the first port means is located in the seal sub and positioned between lower seal means and upper seal means, thereby preventing flow of hydrocarbons uphole.
Figure 4:
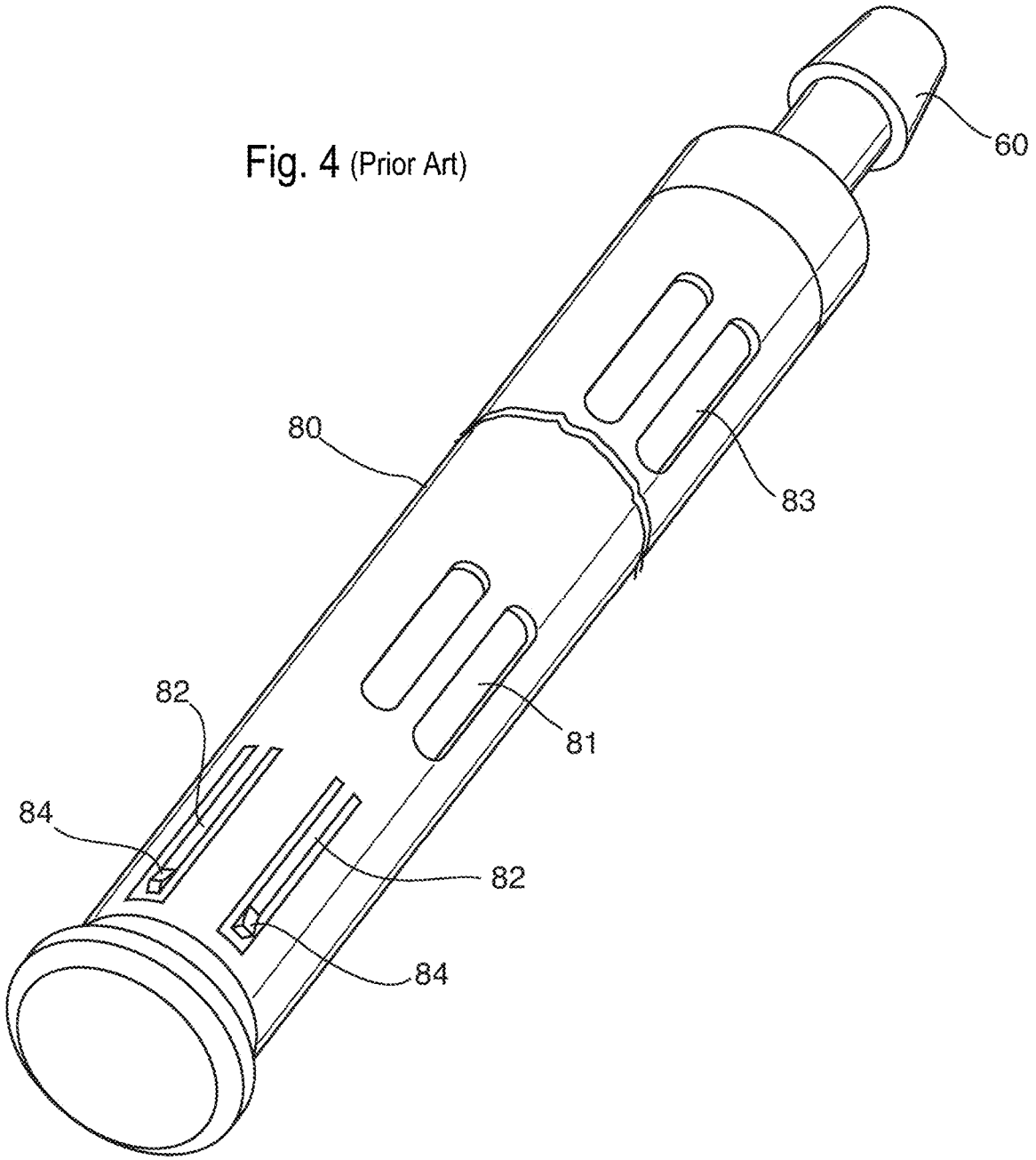
Fig. 4 (Prior Art)
FIG. 4 is a perspective view of the downhole ported sleeve only, which is shown in FIGS. 3A and 3B.

Referring to FIGS. 3A, 3B and 4, an embodiment of the downhole tool 100 of U.S. Pat. No. 8,893,776 is shown. Downhole tool 100 comprises a hollow ported sleeve 80 that is closed on both ends. In a well-producing first position, wellbore fluids enter ported sleeve 80 through first port means 81 in the sidewall of the ported sleeve 80 positioned below lower seal means 26 on the seal sub 24. In this first position, wellbore fluids exit ported sleeve 80 through second port means 83, likewise situated in the sidewall of the ported sleeve 80. In a closed second position, ported sleeve 80 is positioned in seal sub 24 in a manner by which first port means 81 is positioned between lower and upper seal means (26 and 28) on seal sub 24, thereby preventing access of wellbore fluids to the internal hollow cavity of ported sleeve 80. Since ported sleeve 80 is hollow over its entire length, it is essential to its operation that the bottom end of the ported sleeve 80 is closed to the hollow interior. If it were otherwise, ported sleeve 80 would not function to prevent fluids from upward movement to the surface.

Figure 5A:
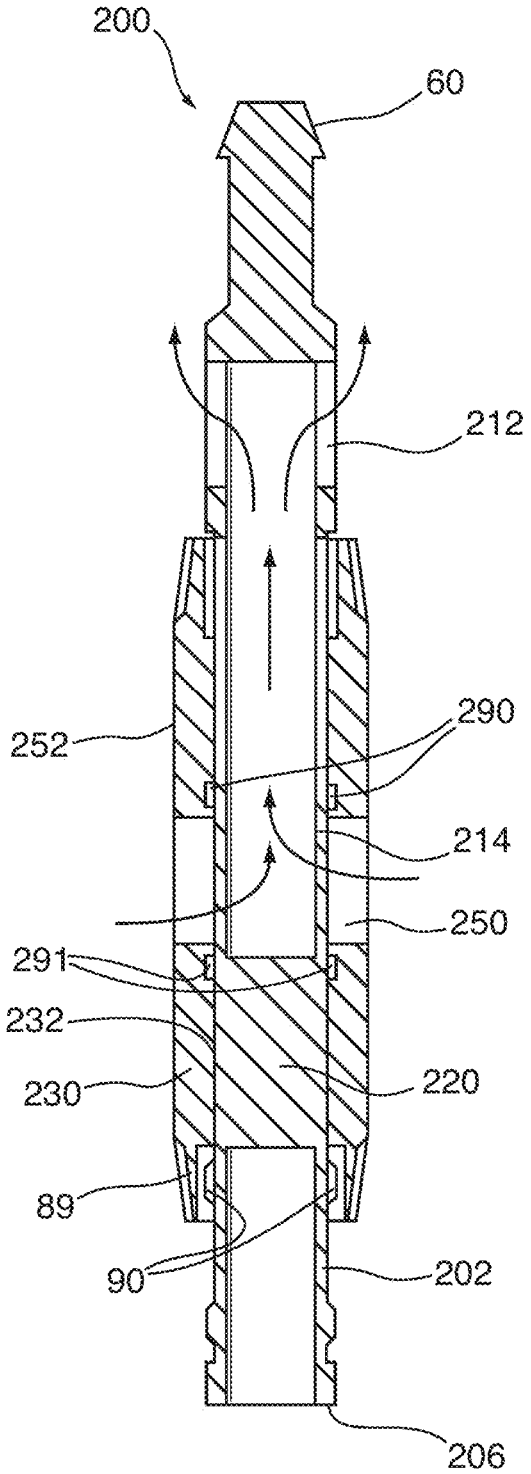
Fig. 5A (Prior Art)
Figure 5B:
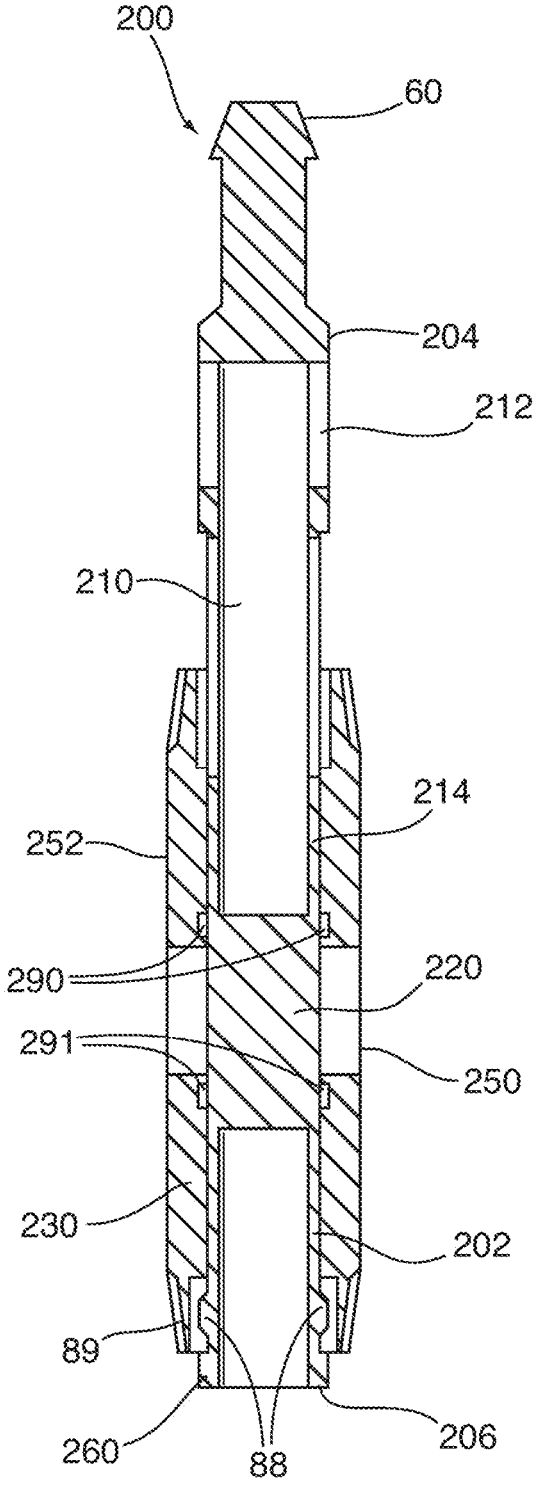
Fig. 5B (Prior Art)
FIG. 5B is a cross-sectional view of the downhole isolation tool shown in FIG. 5A, where the sliding sleeve is repositioned to a second position wherein a seal member occupies the port in the seal sub and blocks the second aperture, thereby preventing flow of hydrocarbons uphole.
Figure 6:
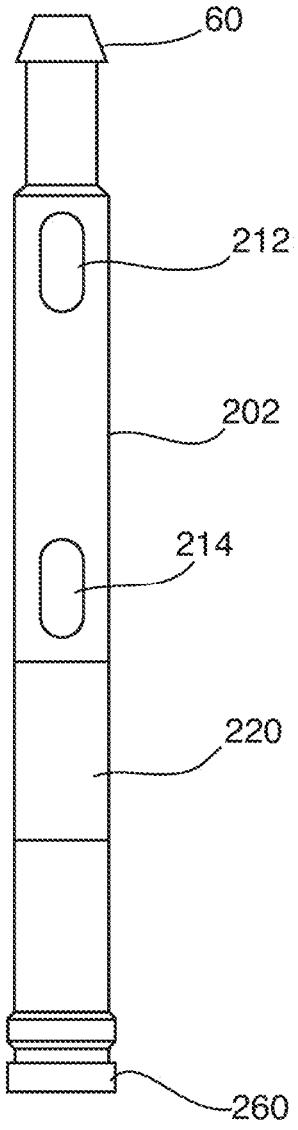
Fig. 6 (Prior Art)
FIG. 6 is a perspective view of the sliding sleeve shown in FIGS. 5A and 5B.

Referring to FIGS. 5A, 5B and 6, an embodiment of the downhole tool 200 of U.S. Pat. No. 8,899,316 is shown. Similar to downhole tool 100, downhole tool 200 comprises a sliding sleeve 202 with a pair of apertures, namely a first aperture 212 situated proximate upper end 204 and a second aperture 214 situated approximately mid-length of sliding sleeve 202. In contrast to downhole tool 100, seal sub 230 of downhole tool 200 comprises a port means in the form of aperture 250, which aperture 250 extends from exterior surface 252 of seal sub 230 through to and is in fluid communication with bore 232. Thus, fluid enters downhole tool 200 through an aperture in the side of the seal sub 230.

In a well-producing first position, wellbore fluids enter sliding sleeve 202 by second aperture means 214 being aligned with port means 250 on the seal sub 230, to allow communication of fluids surrounding the exterior of seal sub 230 into the elongate cavity 210 of sliding sleeve 202. In this first position, wellbore fluids exit sliding sleeve 202 through first aperture means 212, likewise situated in the sidewall of the sliding sleeve 202. In a closed second position, a seal member 220 within sliding sleeve 202 becomes aligned with port means 250, blocking and thereby preventing communication of fluids with the elongate cavity 210 of sliding sleeve 202. Since fluid access to sliding sleeve 202 is through port means 250 in the seal sub 230, it is essential to the operation of downhole tool 200 that the seal member 220 align with and block the port means 250 in the seal sub 230. If it were otherwise, sliding sleeve 202 would not function to prevent fluids from upward movement to the surface.

Figure 7A:
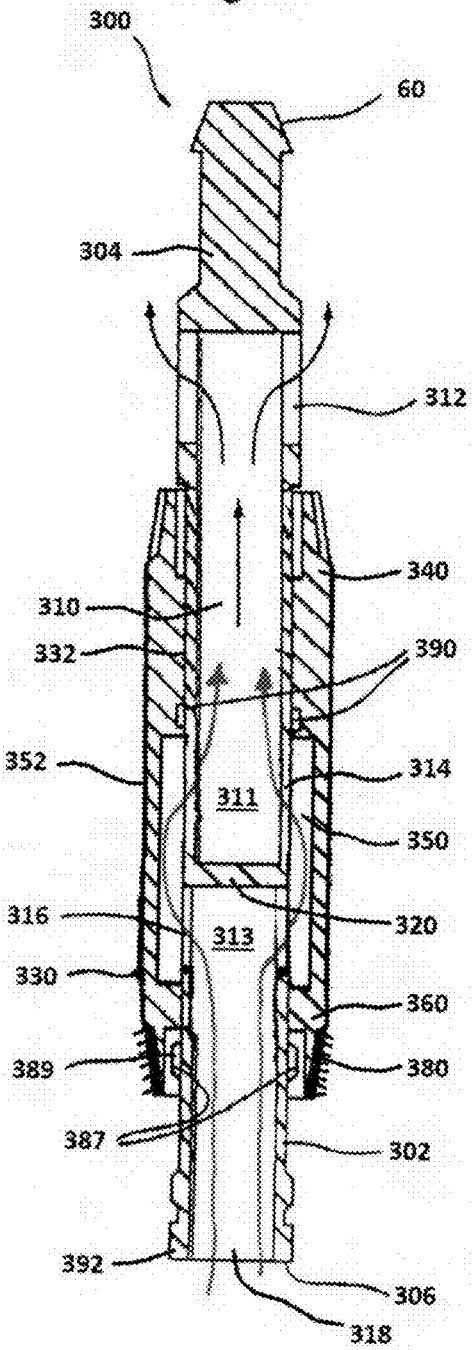
Figure 7B:
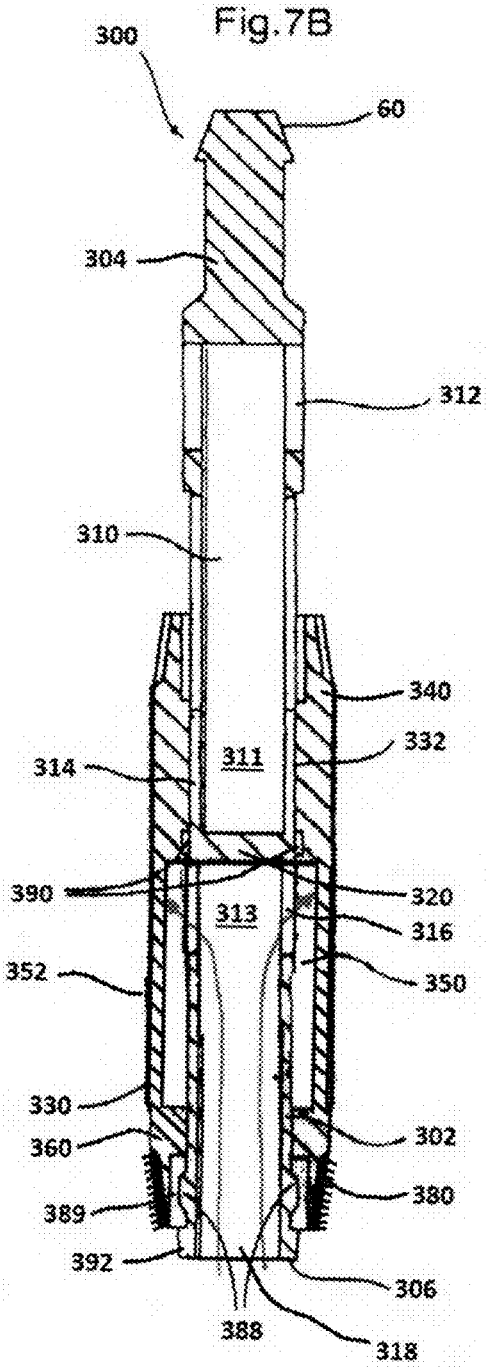
FIG. 7B is a cross-sectional view of the downhole isolation tool of the present invention shown in FIG. 7A, where the sliding sleeve is repositioned to a second position wherein the second aperture and seal member are positioned above the bypass channel, blocking access to the upper cavity from the lower cavity, thereby preventing flow of hydrocarbons uphole.
Figure 8:
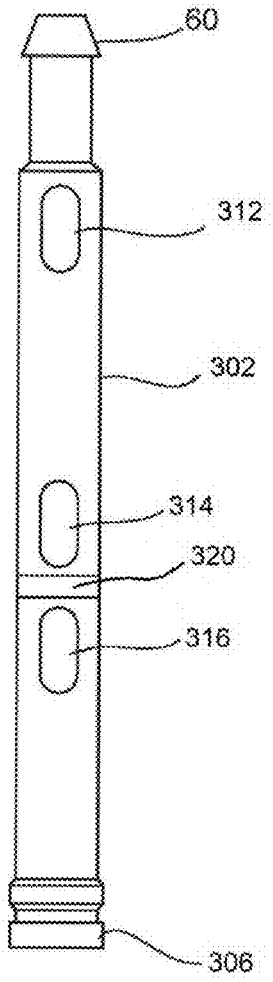
FIG. 8 is a perspective view of the sliding sleeve of the present invention shown in FIGS. 7A and 7B.

FIGS. 7A & 7B and FIG. 8 show a novel downhole isolation tool 300 of the present invention, particularly for use in a well/wellbore 12 wherein seating and sealing engagement of the downhole isolation tool 300 to a downhole assembly (e.g. a gas separator) is desired. The wellbore 12 may further possess a well casing 2, a rod string encased within a polish rod 14, a pump apparatus 4 which has inlet apertures 322 for a pump 6, and a gas separator 400 (see FIGS. 9 and 11-13).

Figure 11:
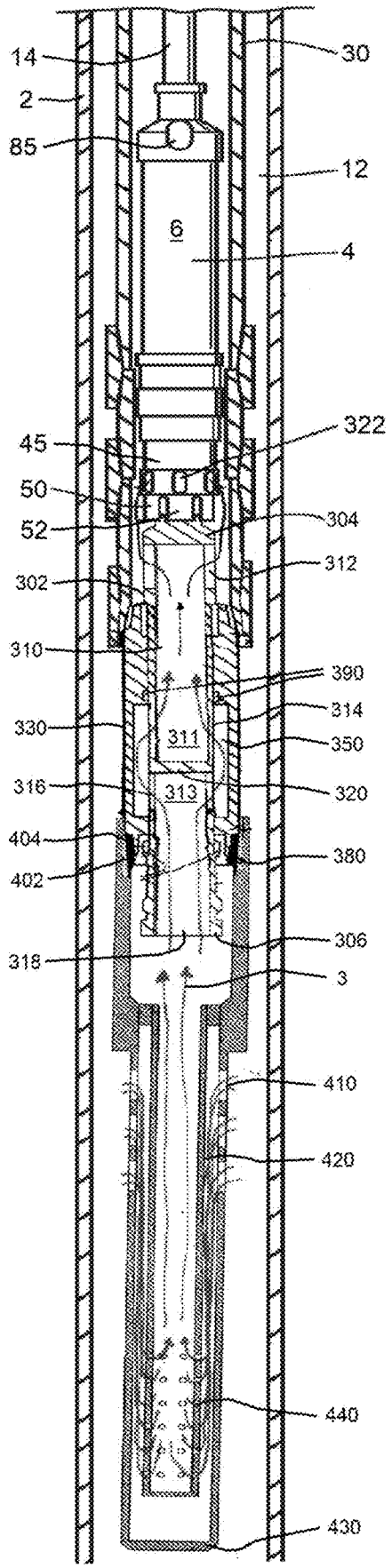
FIG. 11 is a side elevation cross-sectional view of the downhole isolation tool of FIGS. 7A and 7B, affixed to a lower portion of a pump apparatus, and installed downhole in a well bore seated and sealingly engaged to a gas separator, when sliding sleeve thereof is in the first position.
Figure 12:
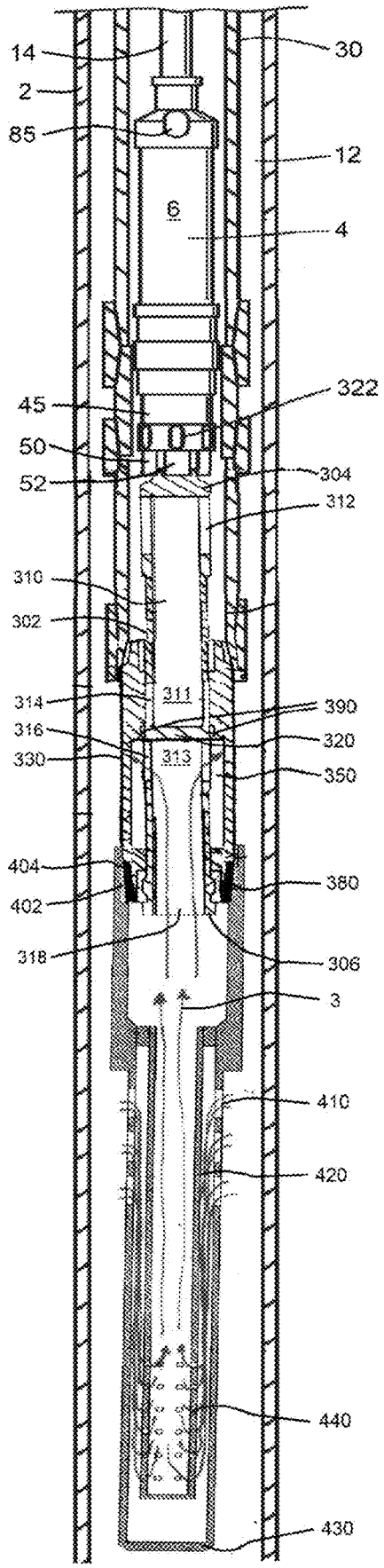
FIG. 12 is a side elevation cross-sectional view of the downhole isolation tool of FIGS. 7A and 7B, affixed to a lower portion of a pump apparatus, and installed downhole in a well bore seated and sealingly engaged to a gas separator, when sliding sleeve thereof is in the second position.
Figure 13:
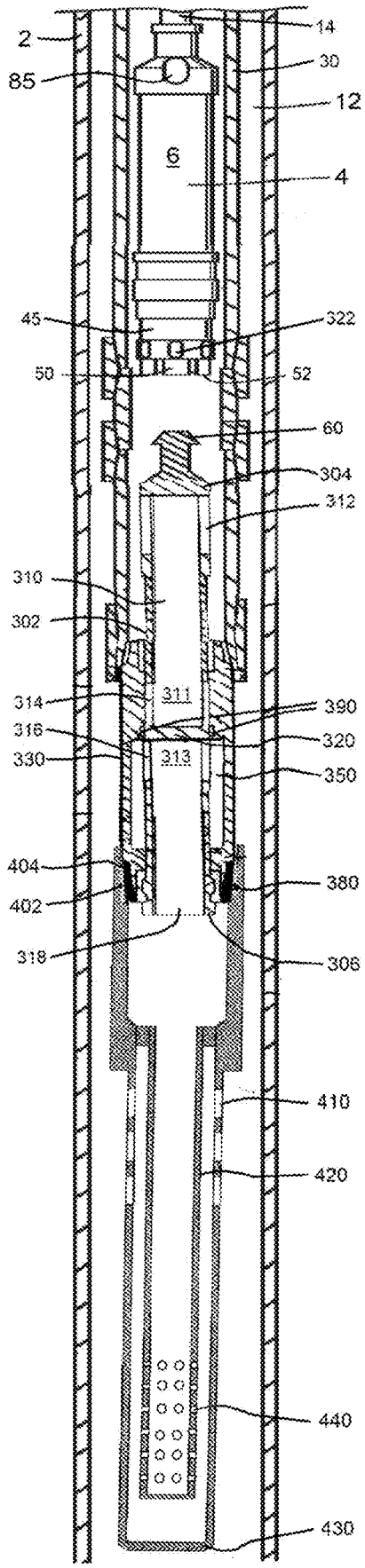
FIG. 13 is a side elevation cross-sectional view of the downhole isolation tool of FIGS. 7A and 7B, installed downhole in a well bore seated and sealingly engaged to a gas separator, when sliding sleeve thereof is in the second position and the pump apparatus is pulled uphole, it becomes detached from the isolation tool, leaving the isolation tool downhole seated and sealingly engaged to the gas separator, preventing hydrocarbons from being in communication uphole.

FIGS. 11-13 show an embodiment of the downhole isolation tool 300 of the present invention and its manner of being deployed downhole in a wellbore 12, wherein the downhole isolation tool 300 is seated and sealingly engaged directly to a gas separator 400 to allow passage of fluids therethrough (FIG. 11), and alternatively its manner of being deployed so as to seal the wellbore 12 (FIG. 12) and thereby allow the pump apparatus 4 and rod string/polish rod 14 to be withdrawn from the wellbore 12 (as shown in FIG. 13).

Specifically, FIGS. 7A-7B show a downhole tool 300 of the present invention in cross-sectional view. Downhole tool 300 is provided with an elongate sliding sleeve 302 with an upper end 304 and lower end 306, and an elongate hollow cavity 310 therein separated into an upper cavity 311 and a lower cavity 313 by a seal member 320. Sliding sleeve 302 is adapted to be slidably positioned in an elongate seal sub 330 having a bore 332, bypass channel 350 and seating means 380.

Downhole tool 300 further comprises releasable latch means 60 at the upper end 304 of the sliding sleeve 302.

FIG. 7A shows such downhole tool 300 in a position (first position) within the seal sub 330 allowing upward movement of fluids such as oil through an opening 318 in the lower cavity 313 of the sliding sleeve 302, through a third aperture means 316 into a bypass channel 350 of the seal sub 330, and into the upper cavity 311 of the sliding sleeve 302 through a second aperture means 314 of the sliding sleeve 302, which fluids may thereafter be drawn and pass out of the sliding sleeve 302 through a first aperture means 312 and into pump apparatus 4 via inlet apertures 322 in a distal end of pump apparatus 4 (see FIG. 11).

FIG. 7B shows such downhole tool 300 slidably repositioned within the seal sub 330 to a position (second position) preventing upward movement of fluids such as oil through downhole tool 300, which advantageously allows for sealing the well 12 after the rod string/polish rod 14 and associated pump apparatus 4 are withdrawn from the well 12. (see FIG. 13). In this closed configuration, downhole tool 300 has repositioned upwardly such that seal member 316 and second aperture means 314 of the sliding sleeve 302 are in a position above the bypass channel 350 of the seal sub 330, preventing movement of fluids into the upper cavity 311 of the sliding sleeve 302.

Sliding sleeve 302 of downhole tool 300, as best shown in FIG. 8, is provided with three separate sets of aperture means, namely a first aperture means 312 situated proximate upper end 304 of tool 300 and in fluid communication with upper cavity 311, second aperture means 314 situated just above seal member 320 and longitudinally separated from first aperture means 312 within upper cavity 311, likewise in fluid communication with upper cavity 311, and third aperture means 316 situated just below seal member 320, in fluid communication with lower cavity 313 but not with upper cavity 311. Sliding sleeve 302 is further provided with an opening 318 in the bottom of lower cavity 313 at lower end 306 of the sliding sleeve 302, which is in fluid communication with the third aperture means 316. Preferably, opening 318 is an open end of the lower cavity 313.

The first, second and third aperture means (312, 314 and 316) each comprise at least one aperture in the sliding sleeve 302 sidewall. Preferably, each of the first, second and third aperture means (312, 314 and 316) comprise at least two apertures in the sliding sleeve 302 sidewall. More preferably, each of the first, second and third aperture means (312, 314 and 316) comprise a plurality of apertures in the sliding sleeve 302 sidewall. In an embodiment, the first, second and third aperture means (312, 314 and 316) may independently comprise any combination of the above, with each aperture means comprising the same of a different number of apertures than the other(s). The apertures may be machined into the sliding sleeve 302 sidewall. The size, shape and arrangement of the apertures can be varied, and would be in the knowledge of a person skilled in the art, in order to maximize the flow of production fluid through the apertures. For example, the apertures may have a uniform shape and size and be positioned equidistant from each other in the sliding sleeve 302. Alternatively, the shape and size of each aperture may be different and the distance between each aperture may vary.

As further seen from FIGS. 7A and 7B, downhole isolation tool 300 is further provided with an elongate seal sub 330, preferably of cylindrical shape, having a bore 332 therethrough for slidably receiving therewithin sliding sleeve 302. A bypass channel 350 is provided along bore 332, situated at a bore surface distal to the upper end 340 and lower end 360 of the seal sub 330. By distal to the upper and lower ends (340 and 360) of the seal sub 330, it is meant that the bypass channel 350 does not extend all the way along the wall of bore 332 to where the bore 332 ends at the upper end 340 and lower end 360 of the seal sub 330. The bypass channel 350 is bounded on its opposite side from bore 332 by the sidewall 352 of the seal sub 330, thereby preventing fluid communication exterior to the seal sub 330 from the bypass channel 350. Exterior surface 252 of seal sub 330 is not in fluid communication with bore 332.

In an embodiment, bypass channel 350 is a circumferential channel in the surface of bore 332. The channel of bypass channel 350 may span any longitudinal length of bore 332 of the seal sub 330, so long as it does not extend to the end of the bore as described above and the channel is wide enough to permit alignment, and fluid communication therewith, of both the second and third aperture means (314 and 316) of the sliding sleeve 302 at the same time (i.e. when sliding sleeve 302 is in the first position as described above). Further, when sliding sleeve 302 is in the second position as described above, seal member 320 of the sliding sleeve 302 should be able to align with a portion of bore 332 that is above the bypass channel 350. Likewise, in a preferred embodiment, first aperture means 312 is also aligned with bore 332 of seal sub 330 when the sliding sleeve 302 is in the second position.

Bore 332 permits slidable movement of sliding sleeve 302 therewithin, from a first position shown in FIG. 7A to a second position shown in FIG. 7B, as described herein. A circumferential seal, such as an "O" ring seal 390, may be provided within bore 332 of seal sub 230 at a position above bypass channel 350, in order to assist in sealingly blocking passage of fluid beyond lower cavity 313 when the sliding sleeve 302 is in the second position.

As further seen from FIGS. 7A and 7B, seal sub 330 comprises a seating means 380. Preferably, seating means 380 is situated at the lower end 360 on an exterior surface of the seal sub 330 so as to advantageously be positioned for seating and sealing engagement of the downhole tool 300 with another downhole assembly, such as a gas separator 400 as shown in FIGS. 9 and 11-13. In an embodiment, the seating means 380 of the seal sub 330 is screw threads capable securely fastening to corresponding screw threads 402 within the upper end of the downhole assembly, such as a gas separator 400. In an embodiment, seating means 380 of the seal sub 330 sealingly engages a circumferential seal 404 situated on seating surface 402.

When pumping from a hydrocarbon production well containing gas and liquid it is known to be desirable to separate the gas from the liquid in order for the pump to operate effectively. For a reciprocating rod pump, one of the most common forms of separation is the modified poor boy gas separator. The function of the separator is to remove as much gas as possible from the gas-oil stream coming from the reservoir. Avoiding the entrance of gas is a key factor in order to keep the downhole pump size and running speed within reasonable limits.

Figure 9A:
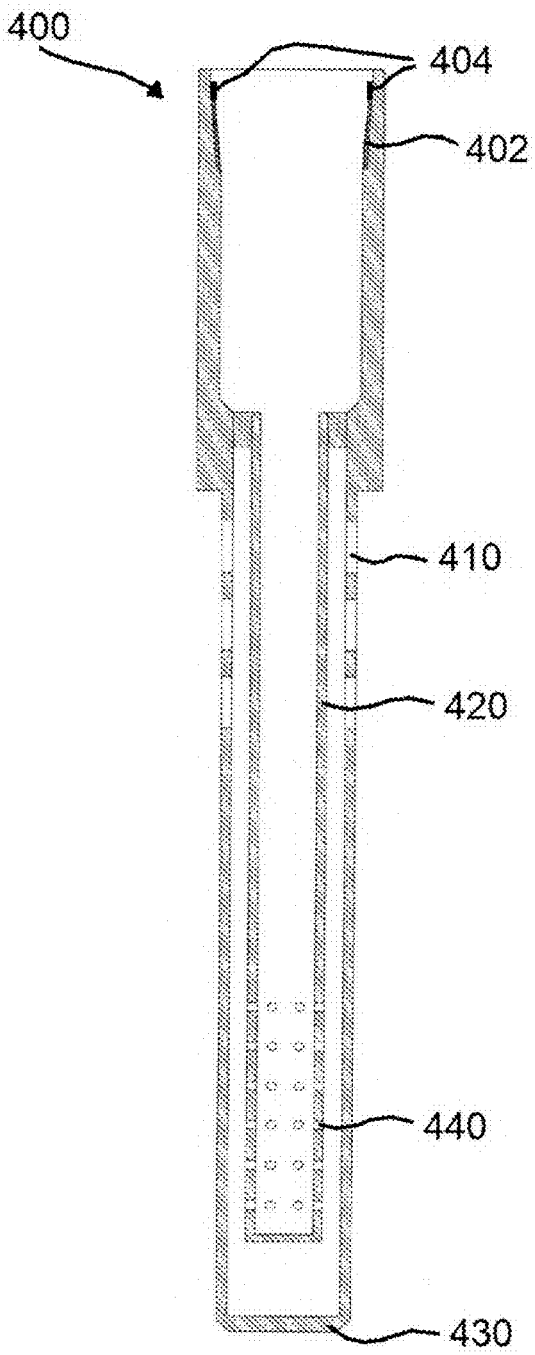
Fig. 9A (Prior Art)
FIG. 9A is a cross-sectional view of a prior art gas separator.
Figure 9B:
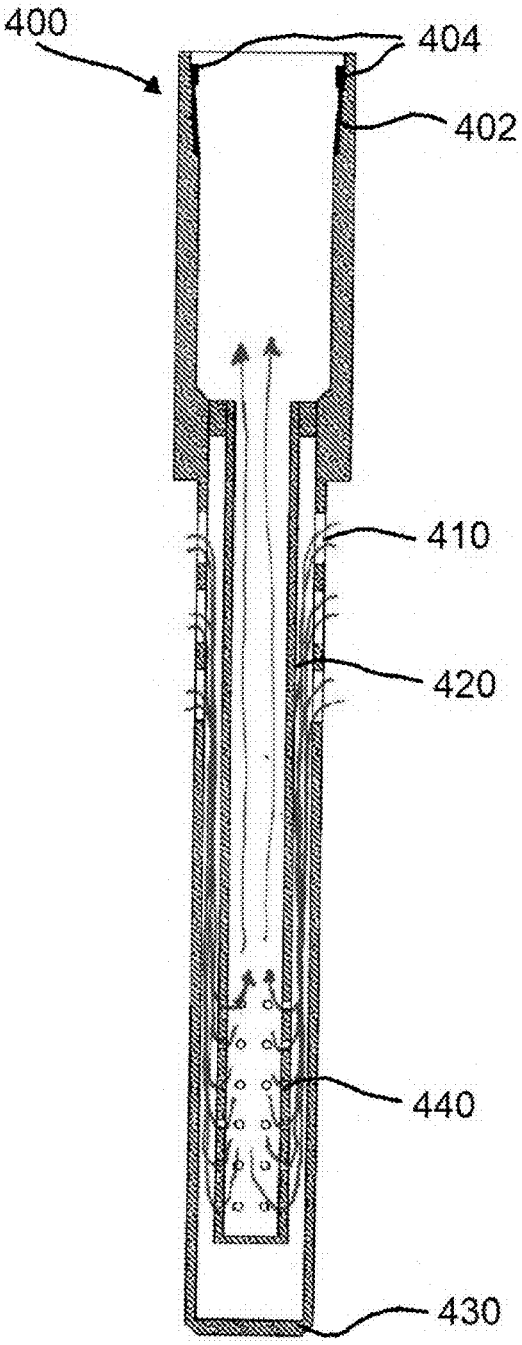
Fig. 9B (Prior Art)
FIG. 9B is a cross-sectional view of a prior art gas separator showing the flow of hydrocarbons through the separator.

A representative diagram of a prior art gas separator 400 is shown in FIG. 9A. Typically, there are two major components of gas separators used wells operating with a reciprocating rod pump, the mud anchor 430 run on the bottom of the tubing string and the dip tube 420 run below the bottom of the pump (see FIG. 10A). In operation (see FIG. 9B), gas-liquid mixture is pulled in through the tubing intake ports 410 on the pump upstroke. During the plunger upstroke, the free gas escapes from the liquid if the gas upward slip velocity is greater than the liquid downhole velocity. On the plunger downstroke, gas slips upward through the stationary liquid. Liquid (e.g. oil) with reduced gas content then enters the separator inlet slots 440 and is pumped to the surface.

Recently, with significant inroads having been made into oil extraction, reservoirs have departed from their pristine initial conditions. Produced gas rates have increased and oil producers now regard downhole gas separation as a key technology for successful operations. However, gas separators are not 100% effective in separating the gas and there are limitations on how much gas can be handled by a downhole gas separator. If more gas is produced than can be handled by the separator, the gas will not separate completely and the downhole pump then must handle the excess gas. This can lead to significant problems in respect of e.g. pump volume efficiency, wasted energy and increased operating costs. Moreover, if excessive gas enters the pump and there is insufficient compression ratio to pump all the fluids, "gas-lock" can occur. When this happens, operating costs increase dramatically because there is no oil production from the well and the pump typically has to be replaced or removed for servicing. It is also commonplace for gas separators themselves to become plugged with sand and other sediment, particularly in wells in heavy oil formations. Thus, increased operating costs and production down-time can also result from having to remove and clean or replace the gas separator or components thereof.

Figure 10A:
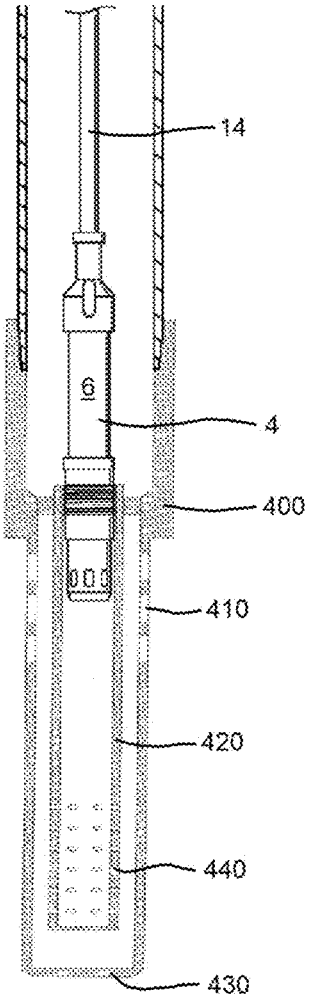
Fig. 10A (Prior Art)
FIG. 10A is a side elevation cross-sectional view of a prior art gas separator and pump apparatus, affixed and installed downhole in an operative configuration.
Figure 10B:
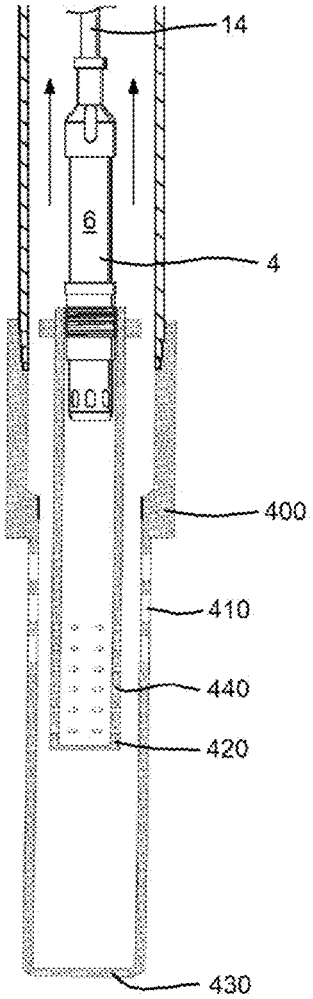
Fig. 10B (Prior Art)
FIG. 10B is a side elevation cross-sectional view of a prior art gas separator and pump apparatus, affixed and being removed from the well for repair, replacement or servicing (e.g. cleaning).

Referring to FIGS. 10A and 10B, a downhole pump assembly 4 and gas separator 400 of the prior art are shown. In FIG. 10A, the pump assembly 4 and gas separator 400 are in an operative configuration, with the pump 6 attached to the dip tube 420 situated within the gas separator 400. When servicing (e.g. cleaning) of the gas separator dip tube 420 is required, it is disadvantageously necessary to unseat and lift both the pump assembly 4 and dip tube out 420 and the well 2 (see FIG. 10B). This is a time consuming and costly process. Moreover, removal of the pump inevitably results in the undesirable need to "kill" the well.

Advantageously, the downhole isolation tool 300 of the present invention is configured so as to be directly compatible with specialized downhole assemblies, such as a gas separator 400. The seating means 380 on the seal sub 330 allows for the downhole tool 300 to be positioned immediately adjacent, and in seated and sealed engagement with the gas separator 400. Likewise, the fluid flow configuration through the downhole tool 300 is designed to be suitable for such applications, with an opening 318 at the bottom and an upper and lower cavity (311 and 313) to which fluid communication is governed by the arrangement of second and third aperture means (314 and 316) with a bypass channel 350. In such novel design, downhole tool 300 is capable of acting as a fluid flow "stop-gate" between the downhole assembly (e.g. gas separator) and other equipment, such as a pump.

Referring to FIGS. 11-13, the method of operation of the downhole tool 300 of the present invention is described in relation to the downhole assembly being a gas separator 400. By operation of the downhole tool 300 of the present invention, there is provided a method for preventing at least one of downhole fluids and gases in a hydrocarbon formation from reaching surface upon removal of a pump assembly 4 from a wellbore 12. The method comprises steps of: (a) providing a sliding sleeve 302 of the present invention as described herein, (b) providing a seal sub 330 of the present invention as described herein, (c) slidably inserting sliding sleeve 302 within bore 332 of seal sub 330 to a first position where second and third apertures (314 and 316) and seal member 320 of sliding sleeve 302 are aligned with bypass channel 350 situated within bore 332 of the seal sub 330 to allow communication of fluids from lower cavity 313 to upper cavity 311 of sliding sleeve 302 by bypassing seal member 320 via bypass channel 350, (d) either before or after step (c), releasably coupling, via releasable latch means 50 (e.g. bulbous spherical knob 60) on upper end 304 of sliding sleeve 302, downhole tool 300 to a lower end 45 of a pump assembly 4, (e) inserting downhole tool 300 and pump assembly 4 downhole into wellbore 12, (f) sealingly engaging downhole tool 300 and pump assembly 4 to gas separator 400 in wellbore 12 via seating means 380 situated on seal sub 330, (g) operating pump assembly 4, (h) raising pump assembly 4 and causing sliding sleeve 302 to be slidably re-located upwardly in bore 332 from the first position to a second position where first aperture means 312 and seal member 320 are positioned above the bypass channel 350 in bore 332 of seal sub 330, to thereby prevent communication of fluids from lower cavity 313 to upper cavity 311 of said sliding sleeve 302, (i) pulling pump assembly 4 upward so as to releasably disengage latch means 60 on sliding sleeve 302 from the lower end 45 of the pump assembly 4, and removing pump assembly 4 from the wellbore 12.

Referring to the above described method, in the downhole operative position, sliding sleeve 302 is positioned in relation to seal sub 330 so that in a producing position, second and third aperture means (314 and 316) are aligned and in fluid communication with bypass channel 350 in bore 332 of seal sub 330.

When pump 6 is activated, a production fluid (e.g. oil 3) is drawn from the well 12 through opening 318 at lower end 306 of sliding sleeve 302 and into lower cavity 313, through third aperture means 316 into bypass channel 350, through second aperture means 314 into upper cavity 311, and out of sliding sleeve 302 through first aperture means 312. The production fluid then enters production tubing 30 into the pump 6 through inlet apertures 322, and through pump 6 and out exit aperture 85 to surface. The sealing engagement between downhole tool 300 and gas separator 400 by seating means 380 on seal sub 330 prevents downhole pressurized fluids and/or gases from reaching surface in an unregulated manner. The fluid flow path through downhole tool 300 also ensures that downhole pressurized fluids and/or gases do not reach the surface in an unregulated manner.

The lower end 45 of pump assembly 4 comprises a releasable latch member 50, which is adapted for releasably coupling and de-coupling sliding sleeve 302 from lower end 45 of pump assembly 4. Latch member 50 may comprise and operate similar to various "on/off" tools used in the industry, wherein in one particular "on/off" tool configuration is a protruding nub, which is releasably insertable into a helical slot milled into an exterior surface of the latch member 50 which forms part of a "J" slot. By lowering latch member 50 onto a component to which it is desired to become releasably coupled (in this case sliding sleeve 302), much like the rotary motion imparted to a child's toy top when a downward motion is imparted, engagement of a protruding lug with a milled helical groove which is part of a milled "j" slot on respectively latch member 50 and coupled component (sliding sleeve 302), when downward force is applied, causes relative rotation of each component relative to the other and thus movement of the lug within the "j" slot portion of the milled "j" slot to thereby couple latch member 50 to coupled component (sliding sleeve 302). To release latch member 50 from releasable securement to sliding sleeve 302 after the pump assembly 4 and sliding sleeve 302 have been raised so that the second aperture means 314 and seal member 320 are positioned above the bypass channel 350 in bore 332 of seal sub 330, a well operator momentarily reverses the direction of movement of the pump assembly 4 from up to down, thereby again forcing latch member 50 downwardly against the then-immobile sliding sleeve 302, and this time due to the action of lug within helical grooves a reverse direction of rotation of the latch member 50 relative to the sliding sleeve 302 is imparted, thereby removing the lug from within the "J" slot and permitting disengagement of the sliding sleeve 302 from latch member 50, to thereby decouple latch member 50 from sliding sleeve 302.

In a preferred embodiment, however, latch member 50 of the present invention comprises a plurality of resiliently flexible, hooked "fingers" 52, adapted to releasably encircle and grasp a protruding bulbous spherical knob 60 (shown in FIGS. 11-13) on the sliding sleeve 302 which extends upwardly therefrom. Each finger 52 may comprise a hook edge 55 to strengthen the connection between the latch member 50 and protruding bulbous knob 60, which in a preferred embodiment may be frusto-conical in shape as shown in FIGS. 12-13, but other geometrical shapes, such as being hemispherical in shape provided a lip edge is provided to engage hook edge 55, would also be satisfactory.

Referring to FIG. 12, when pump 6 is desired to be serviced or replaced, pump assembly 4 is raised from the operative/producing position shown in FIG. 11 to a closed position wherein advantageously the second aperture means 314 and seal member 320 on sliding sleeve 302 are positioned upwardly within seal sub 330 above bypass channel 350, thereby preventing the flow of production fluid from the lower cavity 313 to the upper cavity 311 of the sliding sleeve 302. Due to the sealing engagement between seal member 320 in bore 332 above the bypass channel 350, pressurized fluids and/or gases are prevented from traveling uphole in an unregulated manner. Preferably, in this closed position, seal member 320 aligns with and engages circumferential seal means 390 in the bore 332 of seal sub 330, situated above said bypass channel.

During the raising of pump assembly 4, latch member 50 (already physically coupled to sliding sleeve 302 as shown in FIG. 12) is also raised upwardly within production tubing 30. In an embodiment, a movement-limiting means or stop means may be provided on sliding sleeve 302. In a preferred embodiment, the stop means comprises a protruding lip 392 on sliding sleeve 302 which comes into abutting engagement with a lower extremity of the seal sub 330 when the sliding sleeve 302 is moved into the second position, and serves to operate as a movement-limiting means, as best shown in FIG. 7B, to prevent further upward movement of sliding sleeve 302 past the second position.

Due to operation of protruding lip 392 preventing further upward movement of sliding sleeve 302, further upward movement of pump assembly 4 serves to allow latch means 50 to decouple from bulbous head 60 on sliding sleeve 302, as shown in FIG. 13. In such manner pump assembly 4 may then be drawn upward and removed from well 12 to allow servicing of pump assembly 4, while at the same time hydrocarbons in well 12 are prevented from communication with surface by seating means 380 on seal sub 330 sealingly engaging gas separator 400 and sliding sleeve 302 being in the second position, as shown in FIG. 13.

In an alternative or additional embodiment (see FIG. 7A, 7B), releasably-engageable detent means, such as a biased protrusion 388 on said sliding sleeve 302, may be provided to resiliently engage a corresponding orifice 389 within seal sub 330 when the sliding sleeve 302 is in the second position, may further be provided as shown in FIGS. 7A & 7B, to resist upward or downward movement of the sliding sleeve 302 when such sliding sleeve 302 is in the second position. In an embodiment, such detent means serves to resist upward movement of sliding sleeve 302 past the second position. In an embodiment, such detent means serves to resist sliding sleeve 302 from moving downwardly to the first position and thereby allowing passage of oil or fluids through the downhole tool 300 and possibly uphole to surface. In an embodiment, the detent means may be resilient collet fingers 84, similar to those shown in FIG. 6, to accomplish the released engagement.

Referring to FIG. 13, pump assembly 4 is being raised to the surface and removed from production tubing 30 so that pump 6 can be serviced or replaced. The positioning of sliding sleeve 302, including seating means 380 on seal sub 330 sealingly engaging gas separator 400 and the second aperture means 314 and seal member 320 positioned above bypass channel 350 in bore 332 of the seal sub 330, prevents the passage of downhole pressurized fluid and/or gases from flowing to surface.

Advantageously, when a new or re-serviced pump 6 and pump assembly 4 is desired to be re-inserted downhole, the latch member 50 at the lower end of pump assembly 4 may be lowered in production tubing 30 and lowered onto bulbous spherical knob 60 on sliding sleeve 302, in a reversal of the procedure shown in FIGS. 11-13.

While typically the frictional engagement between the sliding sleeve 302 and the bore 332 of seal sub 330 will assist in allowing the latch member 50 to be re-coupled to ported sleeve 80, a "stop" bar may be provided, positioned within gas separator 400 or other downhole assembly to which downhole tool 302 is seated and sealingly attached.

In a further refinement (see FIG. 7A, 7B), releasably-engageable detent means such as a biased protrusion 387 on said sliding sleeve 302, may be provided to resiliently engage a corresponding orifice 389 within seal sub 330 when the sliding sleeve 302 is in the first position, to resist such sleeve 302 from moving downwardly from the first position and thereby prevent passage of oil or fluids through the downhole tool and possibly uphole to surface when such may be desired.

Referring back to FIGS. 10A and 10B, in an embodiment downhole tool 300 of the present invention advantageously avoids the need to remove the dip tube 420 of gas separator 400 when cleaning is required. As shown in FIGS. 11-13, downhole tool 300 seats and sealingly engages the gas separator 400 upwardly of the dip tube 420. By this sealing engagement, if dip tube 420 becomes plugged (e.g. with sand) it is possible to unseat pump 6 and flush dip tube 420 of the gas separator 400 without its removal. The sealing engagement of the downhole tool 300 with the gas separator 400 prevents the pressure build-up in the gas separator 400 from escaping to the production tubing 30. Also, after reverse flush, sliding sleeve 302 in downhole tool 300 could be moved upwardly in seal sub 330 to the second closed position to further seal the increased pressure within gas separator 400. Thus, with downhole tool 300 is not necessary to unseat and lift the pump 6 and dip tube 420 out of the well (as in prior art FIG. 10B) in order to clean out a plugged dip tube 420 of the gas separator 400. This saves both costs and time in oil production operations.

Likewise, with the aim of saving costs and reducing oil production down-time, in an embodiment downhole tool 300 of the present invention permits pump assembly 4 to be positioned higher in the well and further away from gas separator 400 than in the prior art. Typically, in wells utilizing gas separators, the pump assembly 4 is positioned immediately adjacent the gas separator to maintain unregulated downhole reservoir pressures low in the well during pumping (i.e. not in the production tubing). This necessitates a lengthy rod string/polish rod 14 to extend from the top of the well to the pump 6. The longer the rod string/polish rod 14, the more prone it is to damage and excessive wear that will decrease its lifespan and necessitate removal for repair or replacement. The downhole tool 300 of the present invention, by seating and sealingly engaging a downhole assembly, such as a gas separator 400, allows the pump assembly 4 to be seated higher in the well because downhole tool 300 is capable of preventing downhole pressures from traveling upwards in the well. This should greatly reduce rod wear given that a shorter rod string/polish rod 14 can be used.

In an additional or alternative embodiment, downhole tool 300 of the present invention can be used in a wellbore 12 in combination with Applicant's downhole tools disclosed in U.S. Pat. Nos. 8,893,776 and 8,889,316. As discussed above, it is a safety and regulatory requirement that wells with exceedingly high pressures have at least two barriers in place to prevent pressurized fluids and/or gases from escaping into the atmosphere at the surface of a well. To meet this requirement, an embodiment of the present invention is that downhole tool 300 be used in combination with a downhole tool of U.S. Pat. Nos. 8,893,776 and/or 8,889,316 to reversibly and controllably seal a wellbore 12 at two distinct locations. Downhole tool 300 of the present invention would be positioned low in the well in seating and sealing engagement with a downhole assembly, such as a gas separator 400. In combination with this placement of downhole tool 300, a downhole tool of U.S. Pat. Nos. 8,893,776 and 8,889,316 would be positioned higher up in the wellbore 12 in fluid connection with the production tubing 30. This novel configuration would provide two barriers to downhole pressurized fluids and/or gases from escaping into the atmosphere at the surface of the well. Moreover, the barriers could independently be configured in their open or closed configurations to regulate the flow of fluids and gas up the wellbore 12. In an embodiment, more than two downhole tools may be used, including at least one downhole tool 300 of the present invention. For example, in an embodiment, downhole tool 300 is used in combination with two, three, four, five or more other downhole tools positioned upwardly within the well.

The foregoing description of the disclosed embodiments is provided to enable any person skilled in the art to make or use the present invention. The scope of the claims should not be limited by the preferred embodiments set forth in the examples, but should be given the broadest interpretation consistent with the description as a whole. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties, as well as semi-solids such as tar-like substances.

For a complete definition of the invention and its intended scope, reference is to be made to the summary of the invention and the appended claims read together with and considered with the disclosure and drawings herein.

We claim:

1. A downhole isolation tool adapted for insertion in a wellbore, which when a component thereof is positioned in a first position allows fluids within said wellbore to be drawn through said tool, and when said component is positioned in a second position prevents said fluids from passing therethrough and up the wellbore, comprising:

(A) an elongate sliding sleeve having an upper and lower end and an elongate cavity therewithin separated into an upper cavity and a lower cavity by a seal member that prevents fluid communication between said upper and lower cavity, further having:

(i) a releasable latch member at said upper end of the elongate sliding sleeve, constructed and arranged for releasable coupling to a mating structure situated at a lower end of a pump apparatus;

(ii) an opening at said lower end of the elongate sliding sleeve to allow fluid communication between said wellbore and said lower cavity;

(iii) a first aperture means, situated proximate said upper end, in fluid communication with said upper cavity;

(iv) a second aperture means, situated above said seal member and longitudinally separated from said first aperture means, likewise in fluid communication with said upper cavity; and (v) a third aperture means, situated below said seal member and in fluid communication with said lower cavity;

(B) an elongate seal sub, having an upper and lower end and a bore therethrough for slidably receiving therewithin said sliding sleeve and allowing slidable movement thereof from said first position to said second position, further having:

(i) a bypass channel, situated along said bore at a bore surface distal to said upper and lower ends of said seal sub, and bounded by the sidewall of the seal sub, thereby preventing fluid communication exterior to the seal sub from the bypass channel; and (ii) a seating means capable of sealingly engaging said seal sub to an assembly in the wellbore;

wherein said component is said sliding sleeve, and when said sliding sleeve is in said first position it is positioned within said bore so that said second and third aperture means, and said seal member, are aligned with said bypass channel in said seal sub to allow communication of fluids from said lower cavity to said upper cavity of said sliding sleeve via said bypass channel; and when said sliding sleeve is in said second position, said first aperture means and said member are positioned towards said upper end of said seal sub, above said bypass channel, to thereby prevent communication of fluids from said lower cavity to said upper cavity of said sliding sleeve.

2. The downhole tool as claimed in claim 1, wherein in said second position said seal member aligns with and engages a circumferential seal means in said bore of said seal sub, situated above said bypass channel.

3. The downhole tool as claimed in claim 1, wherein said bypass channel is a circumferential channel in the surface of the bore.

4. The downhole tool as claimed in claim 1, wherein said opening at said lower end of said sliding sleeve comprises an open end of the lower cavity.

5. The downhole tool as claimed in claim 1, wherein said seating means is situated on an exterior surface at said lower end of said seal sub.

6. The downhole tool as claimed in claim 1, wherein said seating means is capable of sealingly engaging a circumferential seal situated on a seating surface of said assembly.

7. The downhole tool as claimed in claim 1, wherein said assembly in said wellbore is a gas separator assembly.

8. The downhole tool as claimed in claim 1, wherein said tool is adapted to be releasably coupleable to the lower end of the pump apparatus when said sliding sleeve is in said first position, and when said sliding sleeve is in said second position is adapted to be decoupled from said lower end of said pump apparatus.

9. The downhole tool as claimed in claim 8, further comprising a movement-limiting structure engageable with a corresponding structure on said seal sub, which prevents said sliding sleeve from further upward movement when said sliding sleeve is at said second position.

10. The downhole tool as claimed in claim 8, further comprising a releasably-engageable detent member engageable with a corresponding structure within said seal sub when said sliding sleeve is in said second position to resist downward slidable movement of said sliding sleeve, and configured to become disengaged upon said pump apparatus being lowered onto said downhole tool and said sliding sleeve being forced downwardly by said pump apparatus.

11. The downhole tool as claimed in claim 8, wherein said sliding sleeve further comprises a releasably-engageable detent member engageable with a corresponding structure within said seal sub when said sliding sleeve is in said first position to resist further downward slidable movement of said sliding sleeve.

12. A method for preventing at least one of downhole fluids and gases in a hydrocarbon formation from reaching surface upon removal of a pump apparatus from a wellbore, using a downhole tool comprising an elongate sliding sleeve and an elongate seal sub, comprising the steps of:

(a) providing an elongate sliding sleeve having an elongate cavity therewithin separated into an upper cavity and a lower cavity by a seal member that prevents fluid communication between the upper and lower cavity, said upper cavity having a first and second aperture therein and said lower cavity having a third aperture therein;

(b) providing an elongate seal sub having a bore therethrough and a bypass channel situated along said bore;

(c) slidably inserting said elongate sliding sleeve within said bore of said seal sub to a first position where said second and third apertures, and said seal member, are aligned with said bypass channel situated within said bore of said seal sub to allow communication of fluids from said lower cavity to said upper cavity of said sliding sleeve by bypassing the seal member via said bypass channel;

(d) either before or after step (c), releasably coupling, via a releasable latch member on an upper end of said sliding sleeve, said downhole tool to a mating structure situated at a lower end of a pump apparatus;

(e) inserting said downhole tool and pump apparatus downhole into a wellbore;

(f) sealingly engaging said downhole tool and pump apparatus to an assembly in said wellbore via a seating means situated on said seal sub;

(g) operating said pump apparatus;

(h) raising said pump apparatus and causing said sliding sleeve to be slidably re-located upwardly in said bore from said first position to a second position where said first aperture means and said seal member are positioned above said bypass channel in said bore of said seal sub, to thereby prevent communication of fluids from said lower cavity to said upper cavity of said sliding sleeve;

(i) pulling said pump apparatus upward so as to releasably disengage the latch member on said sliding sleeve from said lower end of said pump apparatus; and (j) removing said pump apparatus from said wellbore.

13. The method as claimed in claim 12, wherein step (h) comprises slidably relocating said sliding sleeve upwards until said seal member aligns with and engages a circumferential seal means in said bore of said seal sub.

14. The method as claimed in claim 12, further utilizing a stop member on said downhole tool to prevent further upward movement of said sliding sleeve past said second position.

15. The method according to claim 12, further comprising after step (j), the steps of:

(k) lowering said pump assembly within said wellbore so as to cause said pump apparatus to push downwardly on said sliding sleeve; and (l) causing said sliding sleeve to move from said second position back to said first position.

16. A downhole isolation tool for insertion in a wellbore, which when configured to a first position allows fluids within a hydrocarbon formation to be drawn through said tool, and when configured to a second position prevents said fluids from passing therethrough and up the wellbore, comprising:

(A) an elongate sliding sleeve having an upper and lower end and an elongate cavity therewithin separated into an upper cavity and a lower cavity by a seal member that prevents fluid communication between said upper and lower cavity, further having:

(i) a releasable latch means member at said upper end thereof, constructed and arranged for releasably coupling to a mating structure on a pump apparatus;

(ii) an opening at said lower end to allow fluid communication between said wellbore and said lower cavity;

(iii) a first aperture means, situated proximate said upper end, in fluid communication with said upper cavity;

(iv) a second aperture means, situated above said seal member and longitudinally separated from said first aperture means, likewise in fluid communication with said upper cavity;

(v) a third aperture means, situated below said seal member and in fluid communication with said lower cavity; and (B) an elongate cylindrical seal sub, having an upper and lower end and, along a longitudinal axis of said seal sub, a bore therethrough for slidably receiving therewithin said sliding sleeve and allowing slidable movement thereof from said first position to said second position, further having:

(i) a bypass channel, situated along said bore at a bore surface distal to said upper and lower ends of said seal sub, and bounded by the sidewall of the seal sub, thereby preventing fluid communication exterior to the seal sub from the bypass channel; and (ii) a seating means capable of sealingly engaging said seal sub to an assembly in the wellbore;

wherein when said downhole tool is configured in said first position, said sliding sleeve is positioned within said bore so that said second and third aperture means, and said seal member, are aligned with said bypass channel in said seal sub to allow communication of fluids from said lower cavity to said upper cavity of said sliding sleeve via said bypass channel; and wherein when said sliding sleeve is slidably moved upwardly so as to thereby be configured in said second position, said first aperture and said seal member are positioned above said bypass channel to thereby prevent communication of fluids from said lower cavity to said upper cavity of said sliding sleeve.

17. The downhole tool as claimed in claim 16, wherein in said second position said seal member aligns with and engages a circumferential seal means in said bore of said seal sub, situated above said bypass channel.

18. The downhole tool as claimed in claim 16, wherein said bypass channel is a circumferential channel in the surface of the bore.

19. The downhole tool as claimed in claim 16, wherein said seating means is capable of sealingly engaging a circumferential seal situated on a seating surface of said assembly.

20. The downhole tool as claimed in claim 16, wherein said assembly in said wellbore is a gas separator assembly.

* * * * *